US008810458B2

(12) United States Patent
Mumbru et al.

(10) Patent No.: US 8,810,458 B2
(45) Date of Patent: Aug. 19, 2014

(54) HANDHELD DEVICE WITH TWO ANTENNAS, AND METHOD OF ENHANCING THE ISOLATION BETWEEN THE ANTENNAS

(71) Applicant: Fractus, S.A., Sant Cugat del Valles (ES)

(72) Inventors: Josep Mumbru, Barcelona (ES); Jaume Anguera, Castellon (ES); Jordi Soler, Sant Cugat del Valles (ES); Carles Puente, Sant Cugat del Valles (ES)

(73) Assignee: Fractus, S.A., Sant Cugat del Valles (ES)

( * ) Notice: Subject to any disclaimer, the term of this patent is extended or adjusted under 35 U.S.C. 154(b) by 0 days.

(21) Appl. No.: 13/718,348

(22) Filed: Dec. 18, 2012

(65) Prior Publication Data

US 2013/0229317 A1 Sep. 5, 2013

Related U.S. Application Data

(63) Continuation of application No. 13/341,051, filed on Dec. 30, 2011, now Pat. No. 8,362,960, which is a continuation of application No. 11/988,888, filed as application No. PCT/EP2006/007050 on Jul. 18, 2006, now Pat. No. 8,115,686.

(60) Provisional application No. 60/702,205, filed on Jul. 25, 2005.

(30) Foreign Application Priority Data

Jul. 21, 2005 (EP) ..... 05106694

(51) Int. Cl.
*H01Q 1/24* (2006.01)

(52) U.S. Cl.
USPC ..... 343/702; 343/725

(58) Field of Classification Search
USPC ..... 343/702, 700 MS, 846, 767, 725
See application file for complete search history.

(56) References Cited

U.S. PATENT DOCUMENTS 4,739,289 A 4/1988 Cripps
5,666,125 A 9/1997 Luxon (Continued)

FOREIGN PATENT DOCUMENTS

EP 1401050 3/2004
EP 1445821 8/2004

(Continued)

OTHER PUBLICATIONS

Jaggard , D. L. Rebuttal expert report of Dr. Dwight L. Jaggard (redacted version). Fractus. Feb. 16, 2011.

(Continued)

*Primary Examiner* — Hoang V Nguyen
(74) *Attorney, Agent, or Firm* — Winstead PC

(57) ABSTRACT

The invention relates to a handheld device comprising a first antenna (401, 701, 901, 931, 961, 1101, 1151, 1301, 1501) arranged to operate in at least a first frequency band, and a second antenna (402, 702, 902, 1102, 1302, 1502, 2210) arranged to operate in at least a second frequency band, wherein said second frequency band is different from said first frequency band. According to the invention, the second antenna comprises a slot antenna comprising at least one slot in at least one conductive layer. The invention also relates to enhancement of the isolation between first and second antennas in a handheld device.

20 Claims, 23 Drawing Sheets

(56) References Cited

U.S. PATENT DOCUMENTS

Figure 1A:
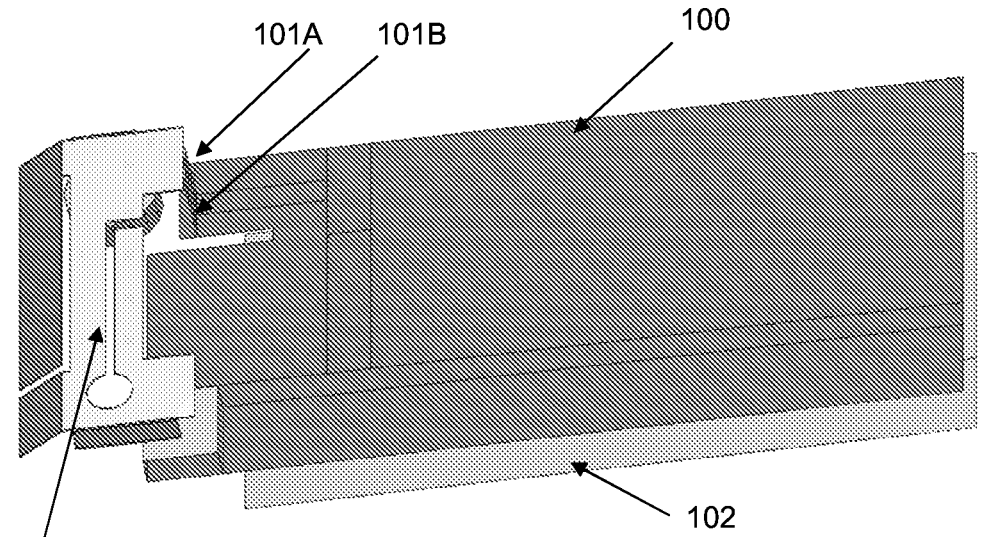

| | | | | |
|---|---|---|---|---|
| 5,784,032 | A | 7/1998 | Johnston | |
| 5,990,838 | A | 11/1999 | Burns et al. | |
| 6,204,819 | B1 | 3/2001 | Hayes et al. | |
| 6,337,662 | B1 | 1/2002 | Cassel | |
| 6,424,300 | B1 | 7/2002 | Sanford | |
| 6,606,071 | B2 | 8/2003 | Cheng et al. | |
| 6,624,789 | B1 | 9/2003 | Kangasvieri et al. | |
| 6,985,108 | B2 | 1/2006 | Mikkola et al. | |
| 6,992,627 | B1 * | 1/2006 | Honda et al. | 343/700 MS |
| 7,170,450 | B2 | 1/2007 | Chang | |
| 7,193,571 | B2 | 3/2007 | Inatsugu | |
| 2002/0167450 | A1 | 11/2002 | Korden et al. | |
| 2002/0175879 | A1 | 11/2002 | Sabet et al. | |
| 2003/0193437 | A1 | 10/2003 | Kangasvieri | |
| 2007/0279289 | A1 | 12/2007 | Baliarda et al. | |

FOREIGN PATENT DOCUMENTS

| | | |
|---|---|---|
| JP | 2005341313 | 12/2005 |
| WO | 01/54225 | 7/2001 |
| WO | 02/29929 | 4/2002 |
| WO | 03/096475 | 11/2003 |
| WO | 2004/068631 | 8/2004 |
| WO | 2004/102744 | 11/2004 |
| WO | 2004/105182 | 12/2004 |
| WO | 2005/076409 | 8/2005 |
| WO | 2006/120250 | 11/2006 |

OTHER PUBLICATIONS

Long , S. Rebuttal expert report of Dr. Stuart A. Long (redacted version). Fractus. Feb. 16, 2011.

Jaggard , D. L. Expert report of Dwight L. Jaggard (redacted)—expert witness retained by Fractus. Fractus. Feb. 23, 2011.

FLOWS project—Antenna feasibility study on the printed antenna elements and the multiple input multiple output ( MIMO ) antenna topologies to be used in Flow mobile terminals. FLOWS project. Nov. 18, 2002.

Antenna designs for MIMO systems. Antenova. Jan. 1, 2004.

Karaboikis , M. et al Compact dual-printed inverted-F antenna diversity systems for portable wireless devices. Antennas and Wireless Propagation Letters, IEEE. Jan. 1, 2004.

Latif, S. I. et al. Bandwidth enhancement and size reduction of microstrip slot antennas. Antennas and Propagation, IEEE Transactions on. Mar. 1, 2005.

Mavridis , G. A. A planar two-branch diversity antenna for wireless applications. Antennas and Propagation Society International Symposium 2006, IEEE. Jul. 9, 2006.

Lindberg , P. et al. Internal active antenna for FM radio reception in mobile handsets. EuCAP. Nov. 8, 2007.

PCT/EP2006/007050—International search report and the written opinion of the International Searching Authority. EPO. Dec. 13, 2006.

PCT/EP2006/007050—Written opinion of the International Searching Authority. EPO. Dec. 13, 2006.

U.S. Appl. No. 11/988,888—Office action dated on Nov. 24, 2010. USPTO. Nov. 24, 2010.

U.S. Appl. No. 11/988,888—Amendment and response to restriction requirement. Winstead. Dec. 17, 2010.

U.S. Appl. No. 11/988,888—Office action dated on Oct. 1, 2011. USPTO. Jan. 10, 2011.

U.S. Appl. No. 11/988,888—Amendment in response to non-final office action dated on Jan. 10, 2011. Winstead. May 31, 2011.

U.S. Appl. No. 11/988,888—Notice of allowance dated on Jul. 12, 2011. USPTO. Jul. 12, 2011.

U.S. Appl. No. 11/988,888—Notice of allowance dated on Oct. 14, 2011. USPTO. Oct. 14, 2011.

** U.S. Appl. No. 13/341,051—Office action summary dated on Feb. 22, 2012. USPTO. Feb. 22, 2012.

** U.S. Appl. No. 13/341,051—Response to the office action dated on Feb. 22, 2012. Winstead PC. May 14, 2012.

** U.S. Appl. No. 13/341,051—Office action summary dated on Jun. 21, 2012. USPTO. Jun. 21, 2012.

** U.S. Appl. No. 13/341,051—Amendment and Response to the final office action dated on Jun. 21, 2012. Winstead. Sep. 14, 2012.

** U.S. Appl. No. 13/341,051—Notice of allowance dated on Sep. 24, 2012. USPTO. Sep. 24, 2012.

* cited by examiner

HANDHELD DEVICE WITH TWO ANTENNAS, AND METHOD OF ENHANCING THE ISOLATION BETWEEN THE ANTENNAS

CROSS-REFERENCE TO RELATED APPLICATIONS

This patent application is a continuation application of U.S. patent application Ser. No. 13/341,051. U.S. patent application Ser. No. 13/341,051 is a continuation application of U.S. patent application Ser. No. 11/988,888. U.S. patent application Ser. No. 11/988,888 is a national-stage filing of Internationa Patent Application No. PCT/EP2006/007050. International Patent Application No. PCT/EP2006/007050 was filed on Jul. 18, 2006. International Patent Application No. PCT/EP2006/007050 claims priority from European Patent Application EP 05106694.2, which was filed on Jul. 21, 2005. International Patent Application No. PCT/EP2006/007050 claims priority from U.S. Provisional Patent Application No. 60/702,205, filed on Jul. 25, 2005. U.S. patent application Ser. No. 13/341,051, U.S. patent application Ser. No. 11/988,888, U.S. Provisional Patent Application No. 60/702,205, International Patent Application No. PCT/EP2006/007050, and EP 05106694.2 are incorporated herein by reference.

OBJECT OF THE INVENTION

The present invention relates to a handset and generally to any handheld device, which includes an antenna for receiving and transmitting electromagnetic wave signals.

It is an object of the present invention to provide a handset or handheld device (such as, for instance, a mobile phone, a smartphone, a PDA, an MP3 player, a headset, a USB dongle, a laptop, a PCMCIA or Cardbus 32 card), which comprises a first antenna (for example, an antenna for mobile communications), and a second antenna (for mobile communications, and/or for at least one wireless connectivity service), said second antenna being a slot antenna. The second antenna can require a very small area on the printed circuit board (PCB) of the hand-held device.

Another aspect of the invention relates to a technique to obtain good isolation between said first antenna and said second antenna. According to the present invention, good isolation between the antennas included in the handset or handheld device can be obtained by appropriately choosing the placement and orientation on the PCB of each one of the antennas comprised in the handset or handheld device, and/or by acting on the PCB (or, rather, on a conductive layer of the PCB, such as a metal layer of the PCB acting as a groundplane for one or both of the antennas) of the handset or handheld device to reduce the electromagnetic coupling between antennas, and/or by other means

BACKGROUND OF THE INVENTION

The current trend in the sector of mobile phone manufacturers, and more generally handheld device manufacturers, is to incorporate added value wireless services, such as connectivity functionality and geolocalization (such as for example, but not limited to Bluetooth™, IEEE802.11a, IEEE802.11b, IEEE802.11g, WLAN, WiFi, UWB, ZigBee, GPS, Galileo, SDARs, XDARS, WiMAX, DAB, FM, DVB-H, or DMB) in more and more of their products. An antenna arranged or configured to operate effectively in a frequency band suitable for one or more of these services or standards is sometimes referred to as a "wireless connectivity antenna" in this document.

In some cases, these handheld devices also operate in at least one frequency band used for mobile communication services, such as GSM (GSM850, GSM900, GSM1800, American GSM or PCS1900, GSM450), UMTS, WCDMA, or CDMA, apart from having the ability to operate in the frequency band corresponding to the wireless connectivity service.

Although it is possible to integrate all the operating bands of a particular handheld device in a single antenna, the trend in the handset manufacturing industry shows that it is preferred to have two separate antennas: A first antenna is used for the bands of the selected mobile communication services (such as, for example, GSM), and a second antenna is used to allow the device to operate at an additional communication service (such as, for instance, UMTS) or at the frequency bands of a wireless connectivity standard (such as, for example, WLAN or Bluetooth™).

Using two separate antennas presents some advantages:

- It can make the design of each one of the antennas easier, as a single multiband antenna covering all the bands of operation of the handset would require a more complicated design.
- It also simplifies the radiofrequency (RF) front-end for each one of the two antennas. If there is only one single antenna, the RF front-end to which the antenna is connected would have to include a diplexer or multiplexer capable of separating the frequency bands corresponding to the different services, for example, separating the mobile communication frequency bands from the wireless connectivity frequency bands.
- Moreover, it offers more flexibility in the design of the PCB that carries the electronic components and circuitry of the handset or handheld device. In many cases, a PCB designer will preferably lay out the module or chipset providing the wireless connectivity functionality, and the module or chipset for the mobile communication services, in different parts of the PCB.

The first antenna can typically be, for instance and without limitation, a monopole antenna, an inverted-F antenna (IFA), a patch antenna, or a planar inverted-F antenna (PIFA). Some known solutions for said second antenna include antennas printed on the PCB of the device (such as, for example, but not limited to, a printed IFA), or an antenna component, or a chip antenna.

However, the integration in a handset of a second antenna dedicated to the wireless connectivity services is not trivial. As the space available on the PCB of the device is scarce, antenna solutions with small footprints are advantageous. Printed antennas are typically not small in size, since their dimensions are approximately a quarter of an operating wavelength of the antenna. Chip antennas may achieve some degree of miniaturization (for instance, by loading the antenna with a material with high dielectric constant), however, in many cases, they exhibit poor matching levels, and limited bandwidth, efficiency and/or gain.

One additional problem that further complicates the integration of the wireless connectivity antenna in a handset or handheld device is the low isolation that is usually obtained between this antenna and the antenna used for mobile communications.

Interband isolation can be improved by separating the two antennas further apart, although this might not be practical in typical handsets due to their small size and due to the limited positions that are available to integrate the wireless connectivity antenna. This is the case especially for more recent handset topologies, like for example flip-type (also known as clamshell) phones and slider-type phones (as the one schematically illustrated in FIGS. 1(A-B)). As an alternative, a filter can be used to achieve the required level of isolation between antennas within the operating bands. However, this approach implies adding extra components on the PCB, thus using up more space on the PCB of the device, and resulting in an increase in cost of the handset.

Figure 1B:
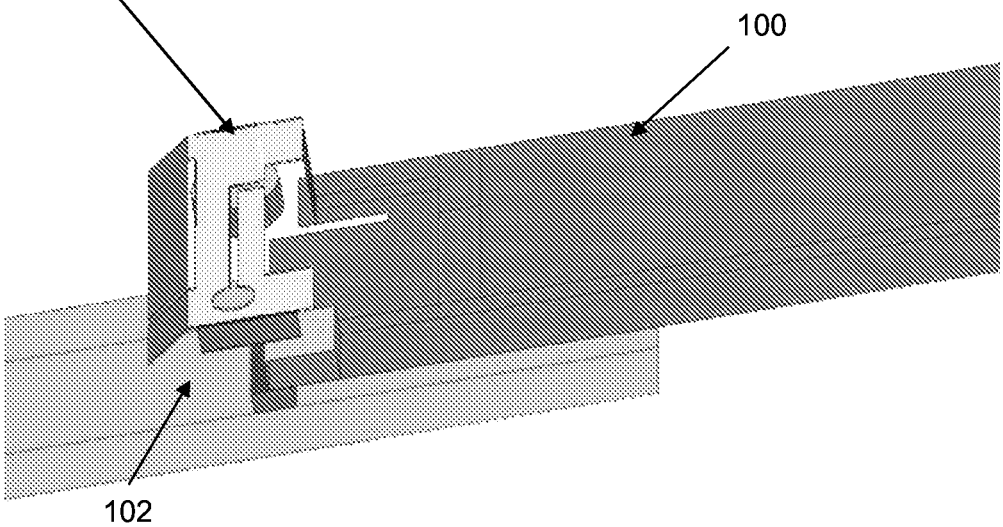
FIG. 1B (PRIOR ART)
Figure 2:
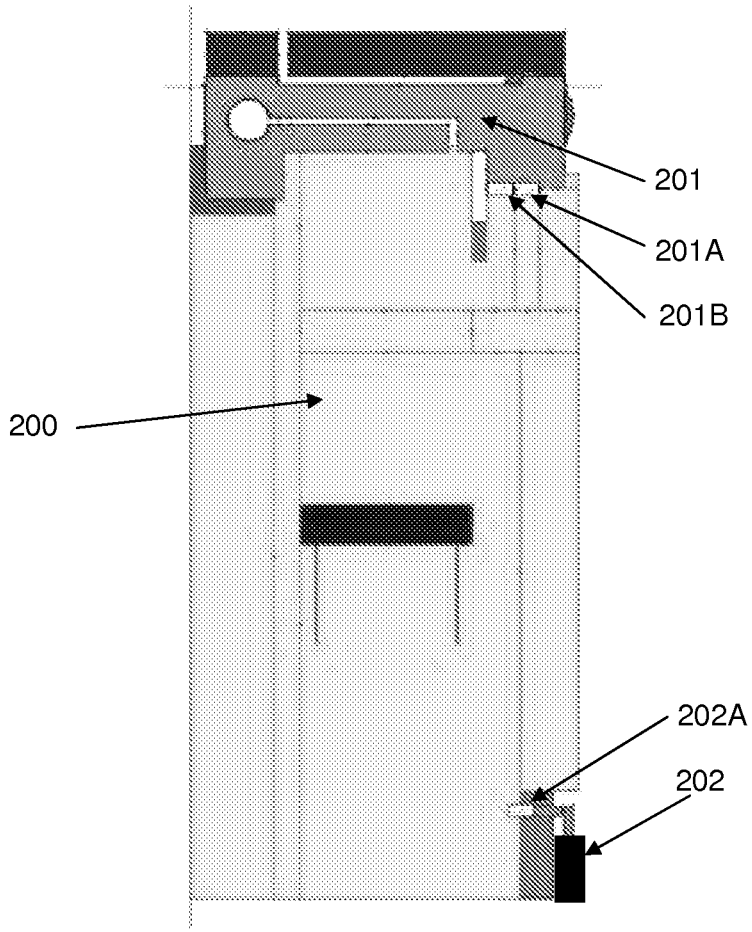
FIG. 2 (PRIOR ART)

A conventional handset that includes an antenna for mobile communications and an antenna for wireless connectivity is depicted in FIG. 2. For this example, the handset has been selected to have a slider-type topology as schematically illustrated in FIGS. 1(A-B). A slider-type handset comprises typically a first PCB (100) placed substantially above and parallel to a second PCB (102). The first PCB (100) has the ability to slide above the second PCB (102), so that the handset can be in a closed position, as shown in FIG. 1A or in an open position, as shown in FIG. 1B. Generally, the first PCB (100) and the second PCB (102) are electrically connected, for example by means of a flexible conductive film (not illustrated in FIGS. 1(A-B)). An antenna 101 is mounted at one end of the first PCB. In this case, the antenna is a Planar Inverted-F Antenna (PIFA), with a short-circuit (101B) to the ground-plane (in this case, to a conductive metal layer of the PCB) and with a feeding point (101A) close to said short-circuit.

For the purpose of the example illustrated in FIG. 2, the handset comprises a first antenna (201), placed on the top part of the first PCB (200), that operates at the frequency bands for mobile communications, and a second antenna (202) placed on the bottom right corner of the PCB (200) that operates at the frequency bands of the wireless connectivity services. The first antenna has a feeding point (201A) and a short-circuit (201B) to ground (namely, to a conductive metal layer of the PCB 200, constituting a ground-plane for the antenna). For illustrative purposes, in the example illustrated in FIG. 2, the second antenna (202) is a surface mount technology (SMT) component mounted on the PCB (200), although it could have been replaced by, for example, an antenna printed on the PCB (200).

Figure 3A:
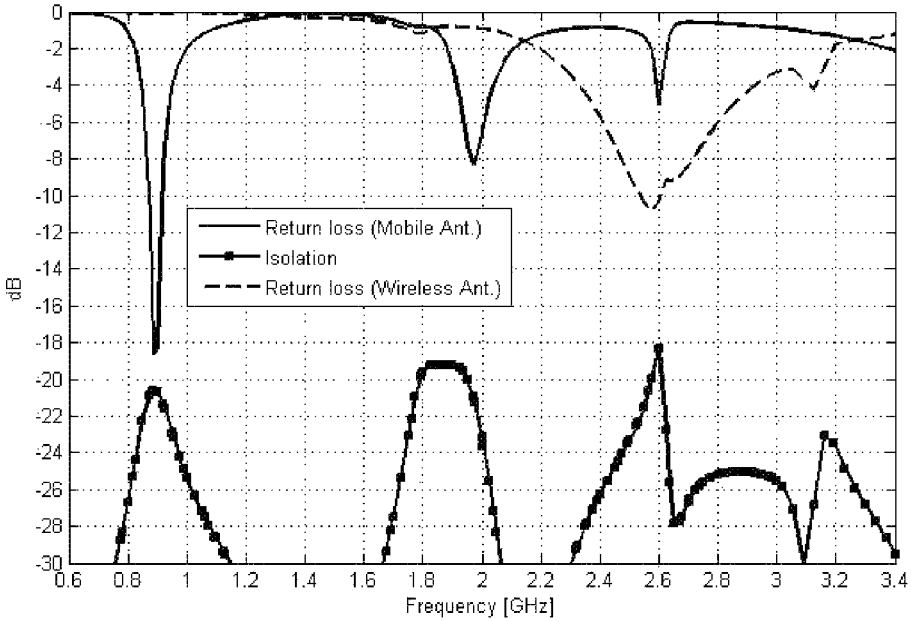
Figure 3B:
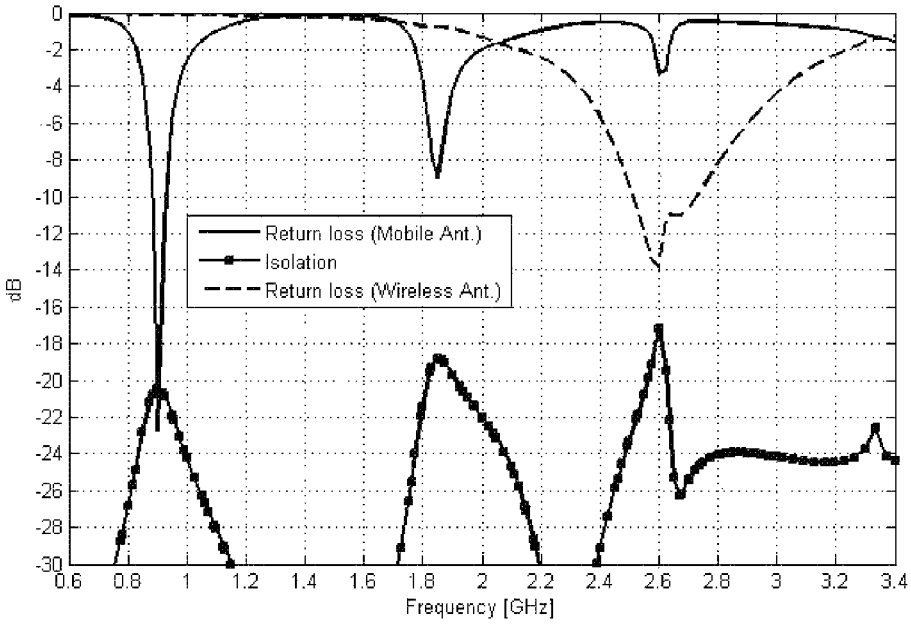
FIG. 3B (PRIOR ART)

Some typical electrical results for the handset of FIG. 2 are shown without any limiting purpose in FIGS. 3(A-B). FIG. 3A presents typical results of the input parameters of the antennas (i.e., return losses of each antenna, and isolation between antennas) when the slider-type phone is in the closed position, while FIG. 3B presents the typical results of the antennas when the phone is in the open position. In this example, the first antenna (201) was designed to have a multi-band behavior, with a first resonance around 900 MHz to provide coverage for the GSM900 service, and a second resonance around 1900 MHz to provide service to the GSM1800 and GSM1900 services. On the other hand, the second antenna was designed to be tuned in the 2500 MHz band. These frequency ranges have been selected just to illustrate the example, but the antennas could work in any frequency band included in the range from approximately 400 MHz to approximately 12 GHz, including any subinterval. The isolation between the first antenna (201) and the second antenna (202) is 20 dB in the 900 MHz band, 18 dB in the 1900 MHz band. The isolation degrades to 17 dB at the center of the resonance of the second antenna around 2600 MHz.

Space Filling Curves

In some embodiments of the invention, at least one antenna of the antennas included in the handset or handheld device may be miniaturized by shaping at least a portion of the conducting trace, conducting wire or contour of a conducting sheet of the antenna (e.g., a part of the arms of a dipole, the perimeter of the patch of a patch antenna, the slot in a slot antenna, the loop perimeter in a loop antenna, or other portions of the antenna) as a space-filling curve (SFC).

An SFC is a curve that is large in terms of physical length but small in terms of the area in which the curve can be included. More precisely, for the purposes of this patent document, an SFC is defined as follows: a curve having at least five segments, or identifiable sections, that are connected in such a way that each segment forms an angle with any adjacent segments, such that no pair of adjacent segments defines a larger straight segment. In addition, an SFC does not intersect with itself at any point except possibly the initial and final point (that is, the whole curve can be arranged as a closed curve or loop, but none of the lesser parts of the curve form a closed curve or loop).

A space-filling curve can be fitted over a flat or curved surface, and due to the angles between segments, the physical length of the curve is larger than that of any straight line that can be fitted in the same area (surface) as the space-filling curve. Additionally, to shape the structure of a miniature antenna, the segments of the SFCs should be shorter than at least one fifth of the free-space operating wavelength, and possibly shorter than one tenth of the free-space operating wavelength. The space-filling curve should include at least five segments in order to provide some antenna size reduction, however a larger number of segments may be used. In general, the larger the number of segments and the narrower the angles between them, the smaller the size of the final antenna.

Box-Counting Curves

In other embodiments of the invention, at least one antenna of the antennas included in the handset or handheld device may be miniaturized by shaping at least a portion of the conducting trace, conducting wire or contour of a conducting sheet of the antenna to have a selected box-counting dimension.

For a given geometry lying on a surface, the box-counting dimension is computed as follows. First, a grid with substantially square identical cells or boxes of size L1 is placed over the geometry, such that the grid completely covers the geometry, that is, no part of the curve is out of the grid. The number of boxes N1 that include at least a point of the geometry are then counted. Second, a grid with boxes of size L2 (L2 being smaller than L1) is also placed over the geometry, such that the grid completely covers the geometry, and the number of boxes N2 that include at least a point of the geometry are counted. The box-counting dimension D is then computed as:

$$D = -\frac{\log(N2) - \log(N1)}{\log(L2) - \log(L1)}$$

For the purposes of the antennas included in the handset or handheld device described herein, the box-counting dimension may be computed by placing the first and second grids inside a minimum rectangular area enclosing the conducting trace, conducting wire or contour of a conducting sheet of the antenna and applying the above algorithm. The first grid should be chosen such that the rectangular area is meshed in an array of at least 5×5 boxes or cells, and the second grid should be chosen such that L2=½ L and such that the second grid includes at least 10×10 boxes. The minimum rectangular area is an area in which there is not an entire row or column on the perimeter of the grid that does not contain any piece of the curve.

The desired box-counting dimension for the curve may be selected to achieve a desired amount of miniaturization. The box-counting dimension should be larger than 1.1 in order to achieve a substantial antenna size reduction. If a larger degree of miniaturization is desired, then a larger box-counting dimension may be selected, such as a box-counting dimension ranging from 1.5 to 3. For the purposes of this patent document, curves in which at least a portion of the geometry of the curve has a box-counting dimension larger than 1.1 are referred to as box-counting curves.

For very small antennas, for example antennas that fit within a rectangle the longest side of which does not exceed one-twentieth the longest free-space operating wavelength of the antenna, the box-counting dimension may be computed using a finer grid. In such a case, the first grid may include a mesh of 10×10 equal cells, and the second grid may include a mesh of 20×20 equal cells. The box-counting dimension (D) may then be calculated using the above equation.

In general, for a given resonant frequency of the antenna, the larger the box-counting dimension, the higher the degree of miniaturization that will be achieved by the antenna. One way to enhance the miniaturization capabilities of the antenna is to arrange the several segments of the curve of the antenna pattern in such a way that the curve intersects at least one point of at least 14 boxes of the first grid with 5×5 boxes or cells enclosing the curve. If a higher degree of miniaturization is desired, then the curve may be arranged to cross at least one of the boxes twice within the 5×5 grid, that is, the curve may include two non-adjacent portions inside at least one of the cells or boxes of the grid.

FIGS. 17(A-B) illustrates an example of how the box-counting dimension of a curve (1700) is calculated. The example curve (1700) is placed under a 5×5 grid (1701) and under a 10×10 grid (1702). As illustrated, the curve (1700) touches N1=25 boxes in the 5×5 grid (1701) and touches N2=78 boxes in the 10×10 grid (1702). In this case, the size of the boxes in the 5×5 grid (1701) is twice the size of the boxes in the 10×10 grid (1702). By applying the above equation, the box-counting dimension of the example curve (1700) may be calculated as D=1.6415. In addition, further miniaturization is achieved in this example because the curve (1700) crosses more than 14 of the 25 boxes in grid (1701), and also crosses at least one box twice, that is, at least one box contains two non-adjacent segments of the curve. More specifically, the curve (1700) in the illustrated example crosses twice in 13 boxes out of the 25 boxes.

Grid Dimension Curves

In some embodiments of the invention, at least one antenna of the antennas included in the handset or handheld device may be miniaturized by shaping at least a portion of the conducting trace, conducting wire or contour of a conducting sheet of the antenna to include a grid dimension curve.

For a given geometry lying on a planar or curved surface, the grid dimension of curve may be calculated as follows. First, a grid with substantially identical cells of size L1 is placed over the geometry of the curve, such that the grid completely covers the geometry, and the number of cells N1 that include at least a point of the geometry are counted. Second, a grid with cells of size L2 (L2 being smaller than L1) is also placed over the geometry, such that the grid completely covers the geometry, and the number of cells N2 that include at least a point of the geometry are counted again. The grid dimension D (sometimes also referred to as $D_g$) is then computed as:

$$D = -\frac{\log(N2) - \log(N1)}{\log(L2) - \log(L1)}$$

For the purposes of the antennas included in the handset or handheld device described herein, the grid dimension may be calculated by placing the first and second grids inside the minimum rectangular area enclosing the curve of the antenna and applying the above algorithm. The minimum rectangular area is an area in which there is not an entire row or column on the perimeter of the grid that does not contain any piece of the curve.

The first grid may, for example, be chosen such that the rectangular area is meshed in an array of at least 25 substantially equal cells. The second grid may, for example, be chosen such that each cell of the first grid is divided in 4 equal cells, such that the size of the new cells is L2=½ L1, and the second grid includes at least 100 cells.

The desired grid dimension for the curve may be selected to achieve a desired amount of miniaturization. The grid dimension should be larger than 1 in order to achieve some antenna size reduction. If a larger degree of miniaturization is desired, then a larger grid dimension may be selected, such as a grid dimension ranging from 1.5-3 (e.g., in case of volumetric structures). In some examples, a curve having a grid dimension of about 2 may be desired. For the purposes of this patent document, a curve having a grid dimension larger than 1 is referred to as a grid dimension curve.

In general, for a given resonant frequency of the antenna, the larger the grid dimension, the higher the degree of miniaturization that will be achieved by the antenna. One example way of enhancing the miniaturization capabilities of the antenna is to arrange the several segments of the curve of the antenna pattern in such a way that the curve intersects at least one point of at least 50% of the cells of the first grid with at least 25 cells enclosing the curve. In another example, a high degree of miniaturization may be achieved by arranging the antenna such that the curve crosses at least one of the cells twice within the 25-cell grid, that is, the curve includes two non-adjacent portions inside at least one of the cells or cells of the grid.

Figure 18:
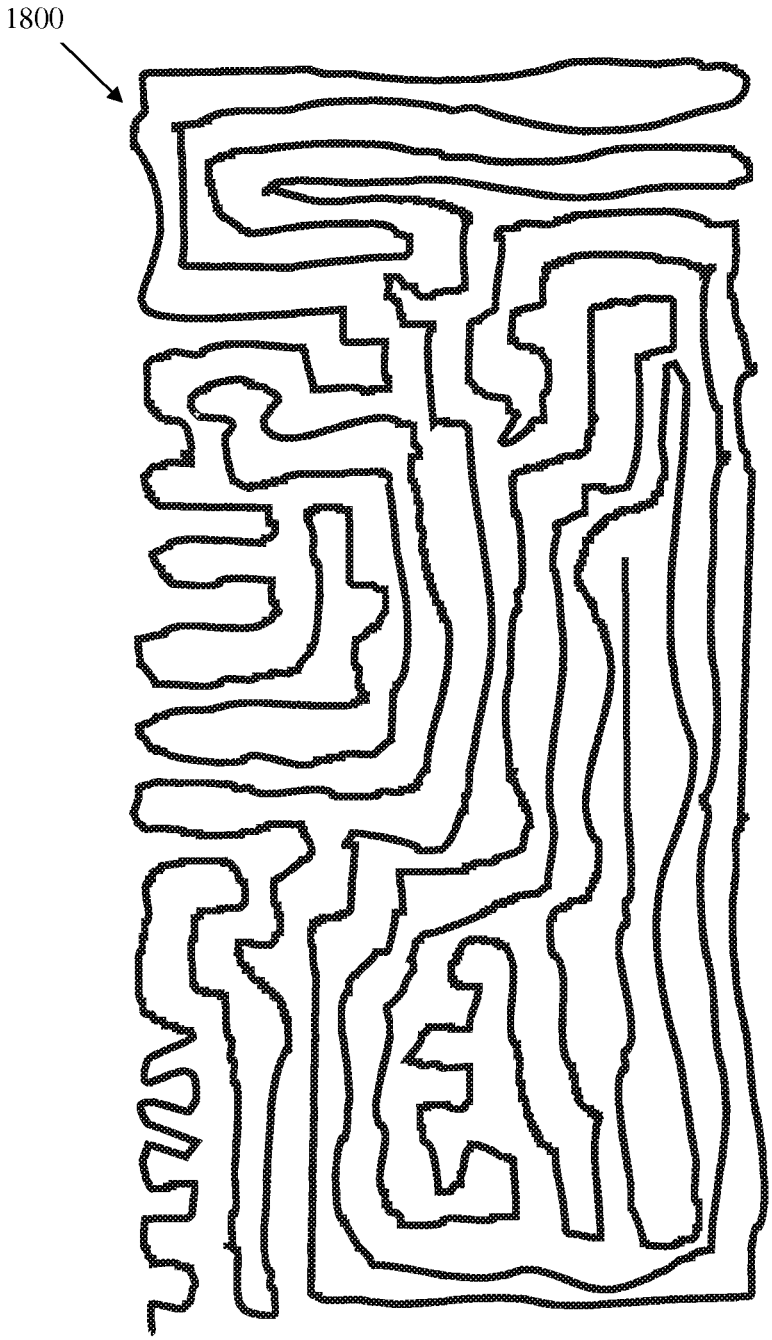
Figure 19:
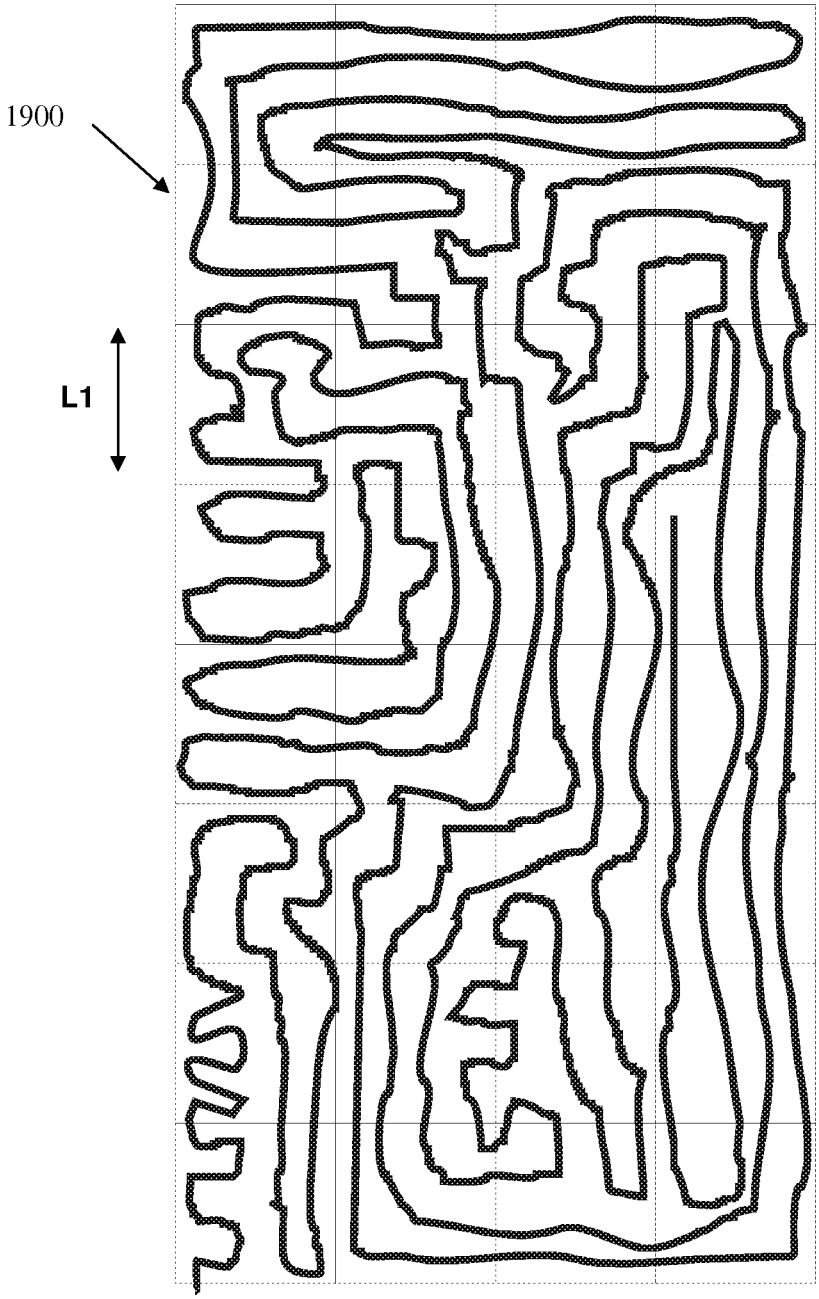
Figure 20:
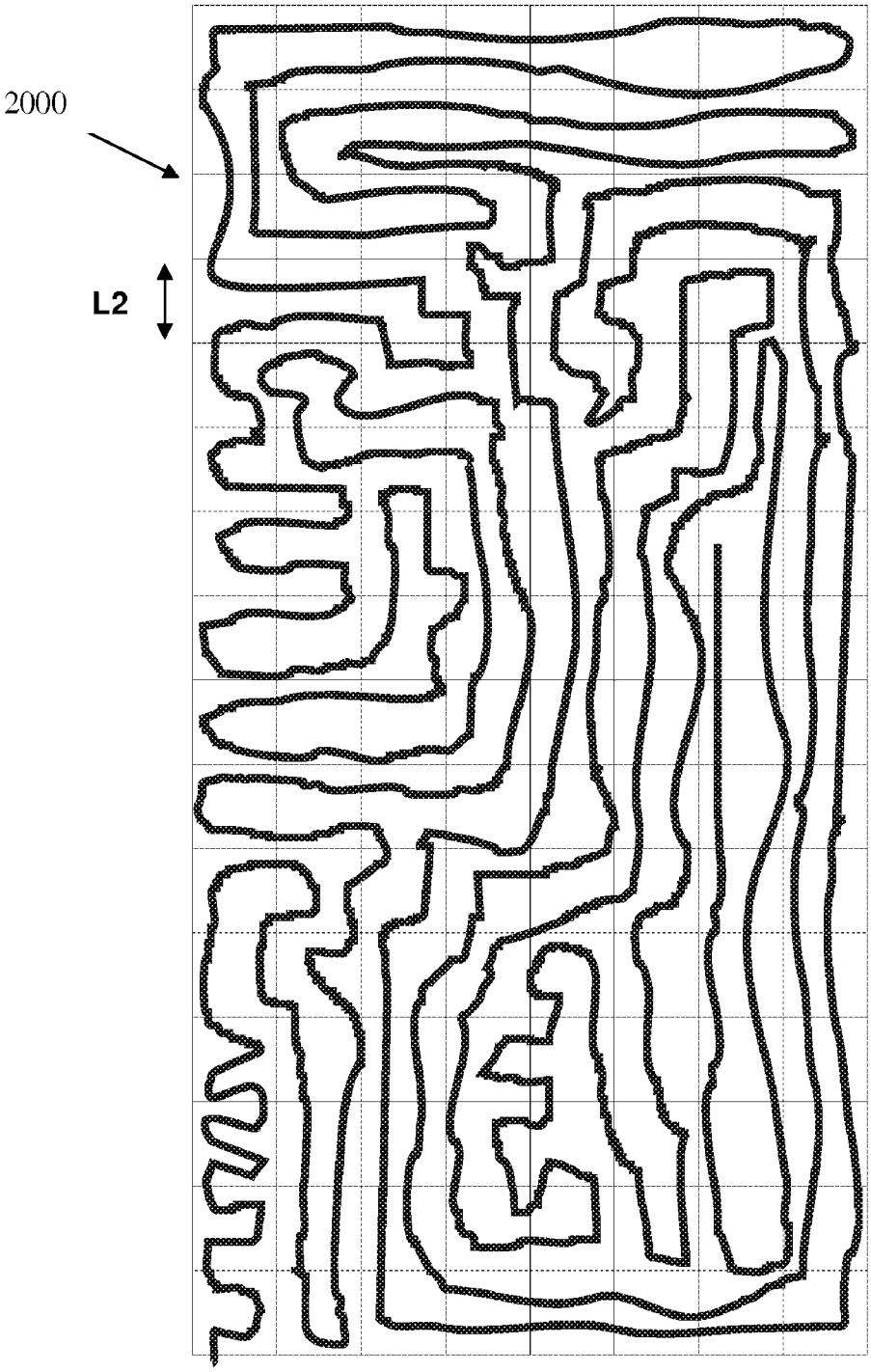

FIG. 18 shows an example of a two-dimensional antenna forming a grid dimension curve 1800 with a grid dimension of approximately two. FIG. 19 shows the antenna of FIG. 18 enclosed in a first grid 1900 having thirty-two (32) square cells, each with a length L1. FIG. 20 shows the same antenna enclosed in a second grid 2000 having one hundred twenty-eight (128) square cells, each with a length L2. The length (L1) of each square cell in the first grid is twice the length (L2) of each square cell in the second grid (L1=2×L2). An examination of FIG. 19 and FIG. 20 reveals that at least a portion of the antenna is enclosed within every square cell in both the first and second grids. Therefore, the value of N1 in the above grid dimension (D, sometimes also referred to as $D_g$) equation is thirty-two (32) (i.e., the total number of cells in the first grid), and the value of N2 is one hundred twenty-eight (128) (i.e., the total number of cells in the second grid). Using the above equation, the grid dimension of the antenna may be calculated as follows:

$$D_g = -\frac{\log(128) - \log(32)}{\log(2 \times L1) - \log(L1)} = 2$$

For a more accurate calculation of the grid dimension, the number of square cells may be increased up to a maximum amount. The maximum number of cells in a grid is dependent upon the resolution of the curve. As the number of cells approaches the maximum, the grid dimension calculation becomes more accurate. If a grid having more than the maximum number of cells is selected, however, then the accuracy of the grid dimension calculation begins to decrease. Typically, the maximum number of cells in a grid is one thousand (1000).

Figure 21:
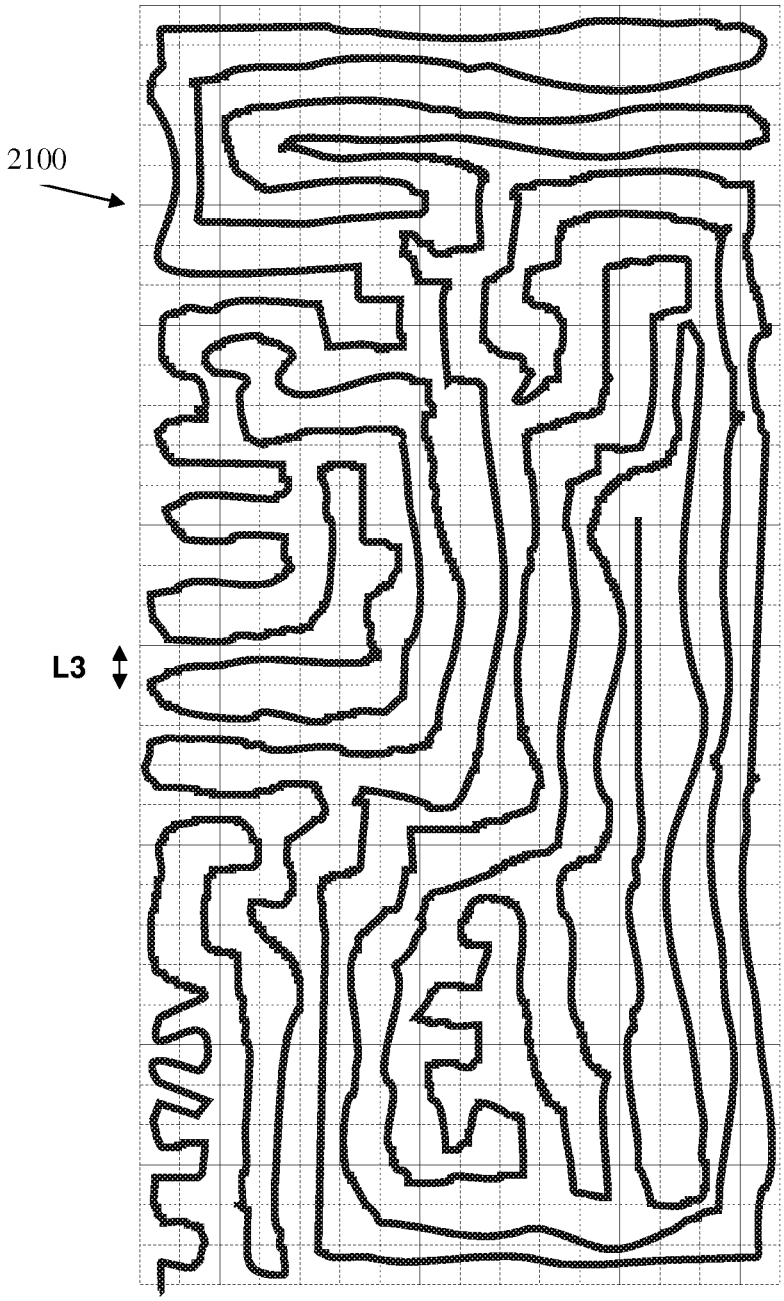

For example, FIG. 21 shows the same antenna as that of FIG. 18 enclosed in a third grid 2100 with five hundred twelve (512) square cells, each having a length L3. The length (L3) of the cells in the third grid is one half the length (L2) of the cells in the second grid, shown in FIG. 20. As noted above, a portion of the antenna is enclosed within every square cell in the second grid, thus the value of N for the second grid is one hundred twenty-eight (128). An examination of FIG. 21, however, reveals that the antenna is enclosed within only five hundred nine (509) of the five hundred twelve (512) cells of the third grid. Therefore, the value of N for the third grid is five hundred nine (509). Using FIG. 20 and FIG. 21, a more accurate value for the grid dimension ($D_g$) of the antenna may be calculated as follows:

$$D_g = -\frac{\log(509) - \log(128)}{\log(2 \times L2) - \log(L2)} \approx 1.9915$$

Multilevel Structures

In some examples, at least a portion of the conducting trace, conducting wire or conducting sheet of at least one antenna of the antennas included in the handset or handheld device may be coupled, either through direct contact or electromagnetic coupling, to a conducting surface, such as a conducting polygonal or multilevel surface. A multilevel structure is formed by gathering several geometrical elements, such as polygons or polyhedrons of the same type (e.g., triangles, parallelepipeds, pentagons, hexagons, circles or ellipses—in this context, circles and ellipses are considered to be polygons with a large number of sides-, as well as tetrahedral, hexahedra, prisms, dodecahedra, etc.) and coupling electromagnetically at least some of such geometrical elements to one or more other elements, whether by proximity or by direct contact between elements. The majority of the elements forming part of a multilevel structure have more than 50% of their perimeter (for polygon and surface like elements) not in contact with any of the other elements of the structure. Thus, the elements of a multilevel structure may typically be identified and distinguished, presenting at least two levels of detail: that of the overall structure and that of the polygon or polyhedron elements that form it.

Additionally, several multilevel structures may be grouped and coupled electromagnetically to each other to form higher-level structures. In a single multilevel structure, all of the component elements are polygons with the same number of sides or are polyhedrons with the same number of faces. However, this characteristic is not present when several multilevel structures of different natures are grouped and electromagnetically coupled to form meta-structures of a higher level.

A multilevel antenna includes at least two levels of detail in the body of the antenna: that of the overall structure and that of the majority of the elements (polygons or polyhedrons) which make it up. This may be achieved by ensuring that the area of contact or intersection (if it exists) between the majority of the elements forming the antenna is only a fraction of the perimeter or surrounding area of said polygons or polyhedrons.

One property of multilevel antennae is that the radioelectric behavior of the antenna can be similar in more than one frequency band. Antenna input parameters (e.g., impedance and radiation pattern) remain similar for several frequency bands (i.e., the antenna has the same level of adaptation or standing wave relationship in each different band), and often the antenna presents almost identical radiation diagrams at different frequencies. The number of frequency bands is proportional to the number of scales or sizes of the polygonal elements or similar sets in which they are grouped contained in the geometry of the main radiating element.

In addition to their multiband behavior, multilevel structure antennae may have a smaller than usual size as compared to other antennae of a simpler structure (such as those consisting of a single polygon or polyhedron). Additionally, the edge-rich and discontinuity-rich structure of a multilevel antenna may enhance the radiation process, relatively increasing the radiation resistance of the antenna and reducing the quality factor Q (i.e., increasing its bandwidth).

A multilevel antenna structure may be used in many antenna configurations, such as dipoles, monopoles, patch or microstrip antennae, coplanar antennae, reflector antennae, wound antennae, antenna arrays, or other antenna configurations. In addition, multilevel antenna structures may be formed using many manufacturing techniques, such as printing on a dielectric substrate by photolithography (printed circuit technique); dieing on metal plate, repulsion on dielectric, or others.

SUMMARY OF THE INVENTION

The invention relates to a device and method as defined in the independent claims. Some embodiments of the invention are defined in respective dependent claims.

The present invention relates inter alia to a handset or handheld device (such as for instance a mobile phone, a smartphone, a PDA, a MP3 player, a headset, a USB dongle, a laptop, a PCMCIA or Cardbus 32 card), which comprises a first antenna for mobile communications (hereinafter also referred to as the mobile antenna), and a second antenna for at least a mobile communication service or a wireless connectivity service (hereinafter also referred to as the wireless connectivity antenna), wherein the said second antenna is a slot antenna. The slot antenna can require a very small area on the PCB.

Slot antennas have conventionally not been considered appropriate for wireless handheld devices. Normally, conventional monopole antennas, patch antennas, inverted-F antennas (IFAs) and planar inverted-F antennas (PIFAs) have been considered more appropriate, maybe due to issues such as radiation efficiency and/or tradition.

However, it has been found that the use of a slot antenna as the wireless connectivity antenna for a handset or handheld device according to the present invention can be advantageous because:

- it has a low profile and uses very little space of the PCB;
- it is less sensitive to the size, shape or form factor of the PCB on which it is printed, etched, or mounted as an SMT component (see below). This can be particularly interesting for flip-type and slider-type handsets in which the antenna needs to stay within functional specifications for the PCB configuration of the handset in both the open and closed positions; and/or it can be polarized along a direction that is substantially orthogonal to the polarization of the mobile antenna.

Actually, using a second antenna in the form of a slot antenna can be preferred inter alia in order to increase the isolation between the antennas. One reason for this is that in order to increase isolation, it can be advantageous to establish the at least two antennas so that the polarization of the radiation of one of the antennas is substantially orthogonal to the polarization of the radiation of another of said antennas.

At a first look, it could seem that this could also be easily accomplished by using, for example, two monopole antennas, directed in appropriate directions so as to establish an orthogonal relationship between the polarization of their radiations. However, a problem involved with hand-held devices is that the radiation of an antenna is substantially conditioned by the ground-plane, that is, normally, by at least one conductive layer of the PCB. In practice, normally both antennas are placed on the same ground-plane, therefore obtaining substantially orthogonally polarized radiation using two antennas of the same type can be a difficult task, due to the influence of the common groundplane. Contrarily, when one of the antennas is a slot antenna, the radiation from said antenna will depend substantially less on the ground-plane, thus facilitating obtaining the above-mentioned orthogonally polarized radiation.

In the present document, the expression "mobile antenna" and similar are used to refer to an antenna arranged to operate in a band corresponding to a mobile communication service, such as one of the mobile communication services mentioned above (GSM-GSM850, GSM900, GSM1800, American GSM or PCS1900, GSM450-, UMTS, WCDMA, and CDMA). In some embodiments of the invention, the expression "mobile antenna" refers to an antenna arranged for or capable of fully functioning or operating in one, two, three or more communication standards, and in particular mobile or cellular communication standards, each standard allocated in one or more frequency bands. In some embodiments of the invention, each of said frequency bands is fully contained within one of the following regions of the electromagnetic spectrum:

the 810 MHz-960 MHz region, the 1710 MHz-1990 MHz region, and the 1900 MHz-2170 MHz region.

The expression "wireless connectivity antenna" as used in this document is defined further above. In some embodiments of the invention, the expression "wireless connectivity antenna" refers to an antenna arranged for or capable of fully functioning or operating in one, two, three or more communication standards, and in particular wireless connectivity standards, each standard allocated in one or more frequency bands. In some embodiments of the invention, each of said frequency bands is contained within one of the following regions of the electromagnetic spectrum, indicated as examples and without limitation:

Industrial, Scientific, Medical (ISM) unlicensed bands, like for example the 915 MHz ISM band (902-928 MHz), 2.4 GHz ISM band (2400-2500 MHz), or 5.7 GHz ISM band (5650-5925 MHz).

Unlicensed general telemetry bands, like for example the 433.05-434.79 MHz band, or the 868-870 MHz band.

According to the present invention, good isolation between antennas can be obtained by appropriately choosing the orientation on the PCB, and by selecting the antenna type (i.e., whether a given antenna substantially behaves as an electric current source, or as a magnetic current source) for each one of the antennas comprised in the handset or handheld device. In the present invention, slot antennas can be considered to substantially behave as magnetic current sources; when fed across the slot, an electric field is established over the slot (and electric currents are flowing along the edges of the slot), and an equivalent magnetic field is established substantially parallel with the extension or orientation of the slot or slots.

In some cases, wherein the first antenna substantially behaves as an electric current source (such as for instance, but not limited to, a monopole antenna) and the second antenna substantially behaves as a magnetic current source (for instance, but not limited to, a slot antenna), good isolation between said first antenna and said second antenna can be obtained when the electric currents excited on at least a portion of the PCB (in this context, when referring to the PCB, reference is actually made to a conductive layer of the PCB, normally constituting a ground-plane of the handheld device) by the radiating mode of said first antenna are substantially parallel to the equivalent magnetic currents excited on at least a portion of the extension of said second antenna.

In other cases, wherein the first and second antenna both behave as magnetic current sources, good isolation between said first antenna and second antenna is achieved when the magnetic currents excited on at least a portion of the extension of the first antenna are substantially orthogonal to the magnetic currents excited on at least a portion of the extension of the second antenna.

In order to improve isolation, the antennas can be placed separated as much as possible within the handset. In order to improve isolation, the antennas can be oriented with respect to each other so as to minimize coupling between the antennas. For example, the slot antenna can be placed on the PCB so that it is arranged substantially parallel to the currents induced in the PCB (in the ground-plane or conductive layer of the PCB) by the first antenna. This can imply, for example, arranging the slot (or slots) of the second antenna to be substantially or generally parallel to one of the sides of the ground-plane, for example, the longer sides of a substantially rectangular ground-plane.

In this document, an antenna or the slot of a slot antenna is considered to extend (to be oriented) in the direction corresponding to the general longitudinal axis of symmetry of the smallest rectangle in which the radiating element of the antenna can be inscribed. Also, in this document, two directions are considered to be substantially parallel if they form an angle of less than or equal to approximately 30 degrees. Two directions are considered to be substantially orthogonal if they form an angle of not less than approximately 60 degrees and not more than approximately 120 degrees.

It can be advantageous to have the slot arranged so that at least two, three, four or more portions of the slot are parallel to each other. This may apply to straight and to non-straight segments. With this parallel arrangement, very compact antennas can be achieved, occupying less space.

The slot antenna can be implemented as a slot printed on or etched in the ground plane of the PCB, while in other cases the slot will be contained in a surface mount technology (SMT) type component mounted on the PCB of the handset or handheld device. When the slot is contained in a SMT type component, said component will comprise a conducting surface on which the slot is created. The SMT type component will provide at least one contact terminal accessible from the exterior of said SMT component to electrically connect said conducting surface with the ground plane of the PCB. In some embodiments, this contact terminal can take the form of a pad, or a pin, or a solder ball. It will be advantageous in some cases to define, on the PCB, a region of clearance of ground plane on the orthogonal projection of the component on the PCB on which it is mounted. In other cases, there will be ground plane on a portion of the orthogonal projection of the SMT component on the PCB, but not under the orthogonal projection of the slot on said PCB.

Yet in other embodiments, there will be ground plane also in a portion of the orthogonal projection of said slot on the PCB. In some examples, the fraction of the projection of the slot occupied by ground plane will be less than, or approximately equal to, 50%, 40%, 30%, 25%, 20%, 10% or 5% of the projection of the slot on the PCB.

A slot antenna integrated in an SMT component can be useful for minimizing the ground plane clearance region needed on the PCB. Embedding a slot antenna in a discrete SMT component can be difficult due to the necessity to ensure good grounding of the conducting sheet in which the slot has been created, and to the complexity to couple the feeding signal into the SMT component.

Some SMT component comprising slot antennas that can be used for the present invention are disclosed in PCT/EP06/062285, the content of which is incorporated herein, by reference.

Accordingly, SMT-type slot-antenna component useful in the present invention can comprise:

- at least one conductive surface (different from the conductive surface of the ground plane of the PCB) or a sheet of metal in which the pattern of a slot is created; and
- at least one contact terminal (also referred to as grounding terminal) accessible from the exterior of said component to electrically connect the conductive surface included in the slot-antenna component with the ground plane of the PCB.

With this component it is possible to provide a slot antenna as a separate component which can be connected from the outside. The antenna may further comprise:

- at least one contact terminal (hereinafter referred to as feeding terminal) to couple an electrical signal from the outside of the SMT-type slot-antenna component with the slot defined in said at least one conductive surface.

It will in principle also be possible to couple a feeding signal into the component indirectly by a capacitive or inductive coupling. For a good feeding, however, a direct electrical connection can be preferred. This can be achieved by the feeding terminal. In any case, the component does not need to have any internal means for generating an RF signal with which the antenna may be fed.

Further, it can be preferred that the component further comprises a

- dielectric substrate that backs said at least one conductive surface or sheet of metal, or in which said at least one conducting surface or sheet of metal is embedded.

The dielectric substrate allows for the backing of thin metal layers and is a widely used technique for the preparation of components for the electronics industry.

The terms sheet of metal and conductive surface are used as synonyms in the present document and relate to a conductive layer that can be supported by a circuit board or a piece of metal (for example, a rigid piece) such as e.g. a stamped metal piece.

Additional pads may be provided which are not electrically connected inside the component or to the ground plane or a feeding element of the circuit board. Those pads may be useful fore mechanically holding the antenna component by the solder connection at that pad between the component and the circuit board.

In some embodiments according to the present invention, the SMT component can also include one or several electronic elements or circuits, or the SMT component can take the form of an IC package. When the slot-antenna component takes the form of an IC package, then the slot contained in said IC package can preferably be excited with an RF feeding signal coupled from outside of said IC package, and not directly from a semiconductor die comprised inside said IC package.

In certain of these embodiments, the electronic elements or circuits included in the SMT component or IC package will preferably be placed within the SMT component or IC package in such a way that they do not interfere with the projection of the slot contained in the SMT component.

In some other embodiments, a slot-antenna component may comprise more than one, two or three conductive surfaces in which a slot or a portion of a slot is created. By this technique it will be possible to "fold" the slot in the vertical direction, away from the PCB. Therefore, the footprint area on the PCB required for such an antenna can be significantly reduced in comparison to antennas where the slot is "folded" in a plane parallel to the PCB surface plane. Most conveniently, two conducting surfaces can be provided on the two opposite large sides of a circuit substrate. If a multilayer circuit substrate is used, further surfaces can be provided in order to form the slot antenna in the component.

The different surfaces may be connected or may remain unconnected. The connection may be done by a hole or by a connection around the edge of a circuit substrate.

In order to protect a conducting layer, it will be advantageous to cover that layer with a protective layer, to prevent corrosion. Further, such a protective layer can be used to define terminals on the conducting layer which are then available for, e.g., a solder connection.

The antenna characteristics can further be chosen by using open-ended or closed-ended slot geometries. Any end of the antenna may be open or closed.

In some embodiments it is advantageous to place grounding terminals to connect the conductive surface with the ground-plane of the PCB close to at least two opposite edges of the slot-antenna component, preferably those two opposite edges that are the farthest apart from each other, so that the electric currents induced by the operation of the slot antenna on the conductive surface can flow through grounding terminals into the ground-plane of the PCB as if the conductive surface and the ground-plane of the PCB were one single conductive surface.

In certain cases it might be interesting to place a grounding terminal substantially close to at least two corners of said at least two opposite edges of the component, preferably the four corners of said two opposite edges of said component.

Further it can be preferred to extend one or more ground terminals along a major part of the length of an edge of the component or of the conductive surface. For example, the ground terminal may extend along at least 40%, 50%, 60%, 70%, 80%, 90% or 95% of the length of an edge. Thereby a good connection of the conductive surface to the ground plane of the PCB can be achieved. This is in particular the case where two grounding terminals extend along opposite edges such as the short and/or the long edges. One ground terminal may also be bent such that it is L-, U- or O-shaped and is preferably provided along one, two, three or four neighboring edges.

Furthermore, in some embodiments it can be advantageous to place grounding terminals at two sides of a feeding terminal and substantially close to said feeding terminal. This arrangement can be used to effectively excite the slot.

Further in some cases it can be advantageous to provide the feeding terminals on two sides of the slot. Then it is possible to combine the slot with another slot by connecting the respective two edges of the two slots, thereby forming a larger slot.

In some embodiments the feeding means of the slot-antenna component comprise a feeding contact and a conductive strip. Said conductive strip can be advantageously printed or etched on the same conductive surface as the slot, thus making the feeding means coplanar with the slot. The conductive strip connects the feeding terminal with the edge of slot that is farther away from the contact terminal.

A clearance region can be provided at least on one, two, or three sides of the feeding terminal. This is in particular useful if the terminal is only used for feeding purposes. If the feeding terminal is also used for grounding purposes such clearance might not be present.

Also for the conductive strip a clearance may be provided. This clearance may not be necessary if the conductive strip is provided on a different level than the conductive surface with the slot. If the conductive strip is provided on a different level it may be connected to the conductive surface of the slot by a via hole or capacitive or inductive coupling. In the same way, the coupling between the feeding terminal and the conductive strip may be made by capacitive, inductive or direct electrical contact coupling.

In order to form pads on the PCB for receiving the terminals of the antenna component without however unnecessarily reducing the ground plane clearance, it is advantageous to provided protrusions of the ground plane which extend into clearance.

Further, the size of the area of the clearance may be smaller than the size of the antenna component.

In certain embodiments, the slot-antenna component is electrically coupled, by means of feeding terminals, with a slot created on the ground-plane of the PCB of the wireless device. In other words, a slot antenna is formed by combining the slot pattern printed or etched in the ground plane of the PCB, with the slot pattern included in the SMT component. Having a portion of the slot antenna printed or etched in the ground plane of the PCB can be advantageous, particularly because this:

- allows the fine tuning of the antenna to account for changes in the dimensions and/or form factor of the ground plane of the PCB to which the slot-antenna component is connected, or the effects of dielectric (e.g., plastic) casings or enclosures, by simply acting on the portion of the slot antenna printed on the ground plane of the PCB.
- provides the PCB designer with more flexibility when laying out the different electronic components on the PCB, as the shape of the portion of slot antenna created in the ground plane can be selected, for example, to meet space constraints, or to minimize the distance of the antenna to the RF circuit.

Since this is achieved by acting only on the portion of the slot printed or etched on the ground plane of a PCB, while leaving the geometry of the slot contained in a conductive surface of an SMT component unchanged, such embodiments are effective in providing a standard component that can be used in a great variety of application environments.

In order to arrange the antenna such that as much space as possible is left over for other components, it can be advantageous to orient an edge, especially a long edge, of the SMT-type slot antenna component substantially parallel to the short or long edge of the circuit board.

The antenna component should not be to far away from the edge of the PCB. This facilitates providing a clearance and assures good radiation characteristics.

In some embodiments, the antenna component is preferably located on or close to the middle of an edge and in particular on or close to the middle of a long edge of the circuit board or the ground plane. A symmetric location with respect to the ground plane can provide a more predictable polarization characteristic since currents induced in the ground plane are not redirected in an asymmetric way by the shape of the ground plane. This may apply even if the antenna itself is not symmetric but the location of the antenna on the ground plane is symmetric or almost symmetric.

The slot of the component may be excited by balanced or unbalanced feeding. This can be done with the help of a coplanar or coaxial transmission line or a microstrip transmission line.

By combining the slot of a ground plane and the slot of a slot-antenna component it is possible to obtain combined slots which are open at none, one, or two ends.

If such a combined slot is provided, this combined slot may be excited by exciting the slot portion of the antenna component or the slot portion of the ground plane. The latter may be preferred since with this technique it is possible to connect an RF-generator directly with the ground plane of the circuit board on which the RF-generator itself is arranged.

Another aspect of the invention relates to a technique to further improve the isolation between a mobile antenna and a wireless connectivity antenna in a handset or handheld device, for example, by acting on the geometry of the mobile antenna to eliminate any resonance modes that might fall within any of the operating bands of the wireless connectivity antenna, in line with what is claimed and described below. In the present text, "operating band" especially implies a band in which the antenna features similar values for a number of parameters representative of the antenna performance.

LIST OF FIGURES

Further characteristics and advantages of the invention will become apparent in view of the detailed description which follows of some preferred embodiments of the invention given for purposes of illustration only and in no way meant as a definition of the limits of the invention, made with reference to the accompanying drawings, in which:

FIGS. 1(A-B)—Example of a prior art slider-type handset carrying an antenna for mobile communications (101) and comprising a top PCB (100) (the dimensions of which could be, for example, 78 mm×40 mm) and a bottom PCB (102) (for example, with the dimensions 70 mm×35 mm): (FIG. 1A) General view of the PCBs of the handset in the closed position; and (FIG. 1B) general view of the PCBs of the handset in the open position.

FIG. 2—Top view of an example of a prior art handset comprising a first antenna for mobile communications placed on the top portion of the PCB of the handset and a second antenna for wireless connectivity services placed on the bottom right corner of the PCB.

FIGS. 3(A-B)—Typical electrical performance of the antennas of the handset shown in FIG. 3A: Return loss of each antenna and isolation between antennas when the handset is in closed position; and (FIG. 3B) return loss of each antenna and isolation between antennas when the handset is in open position.

Figures 4A, 4B:
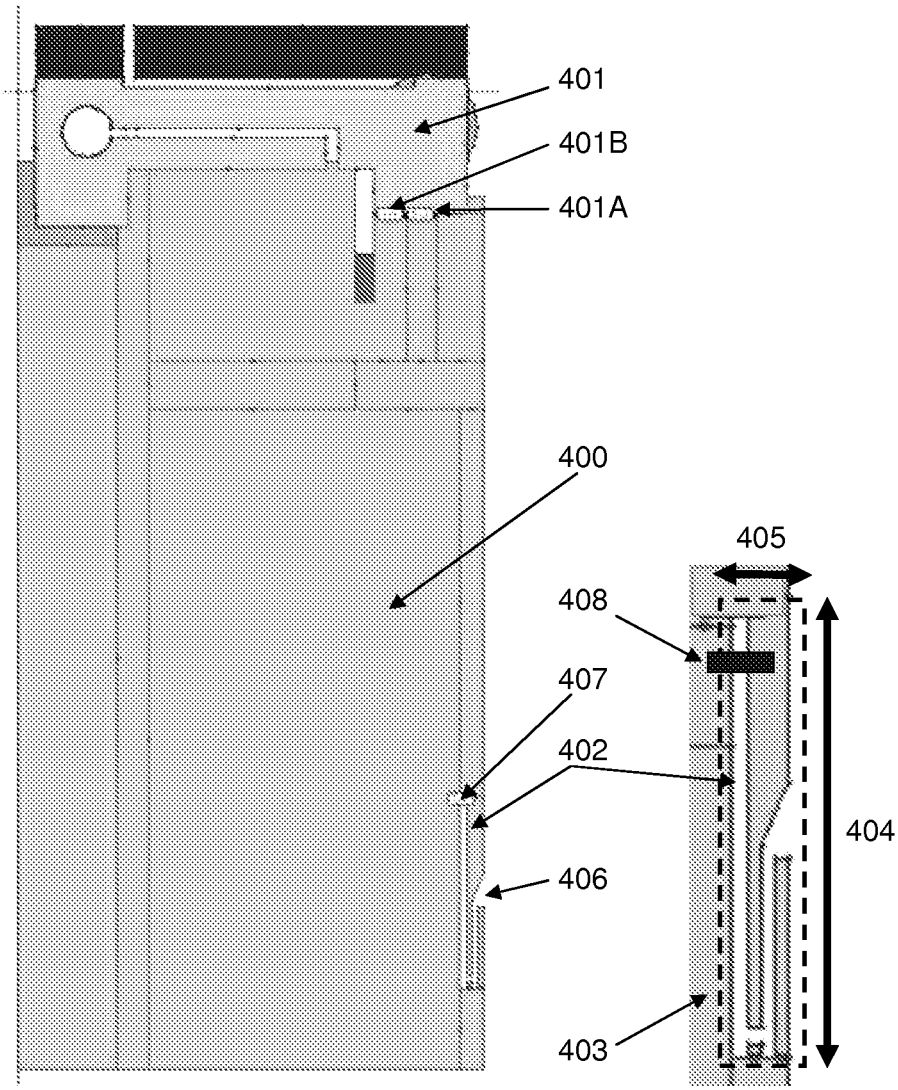

FIGS. 4(A-B)—Top view of a handset according to an embodiment of the present invention, including a first antenna for mobile communications placed on the top portion of the PCB of the handset and a second antenna for wireless connectivity services placed on the bottom right corner of the PCB, wherein the second antenna is a slot antenna: (FIG. 4A)

General view of the PCB of the handset carrying the two antennas; and (FIG. 4B) detailed view of the region that contains the slot antenna.

Figure 5A:
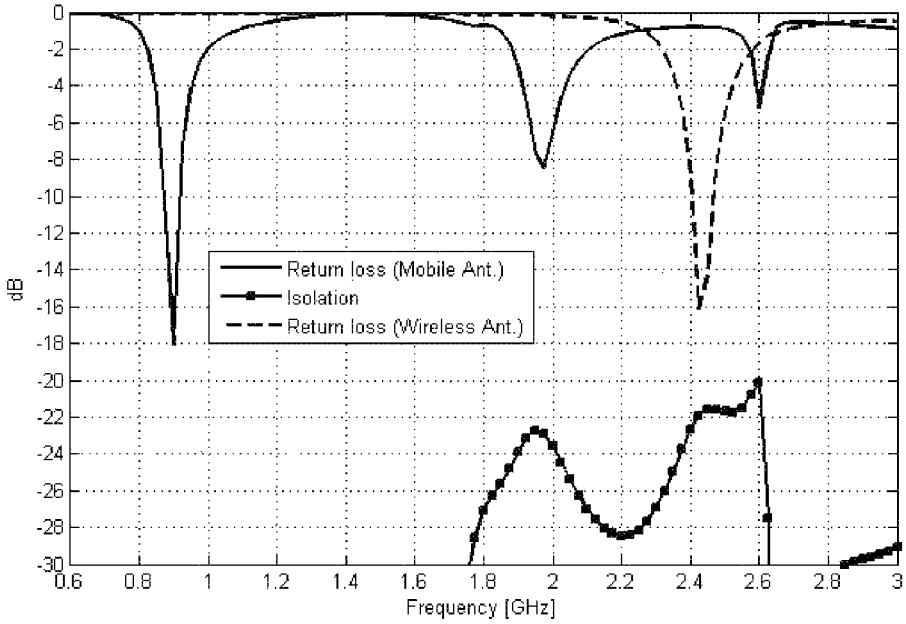
Figure 5B:
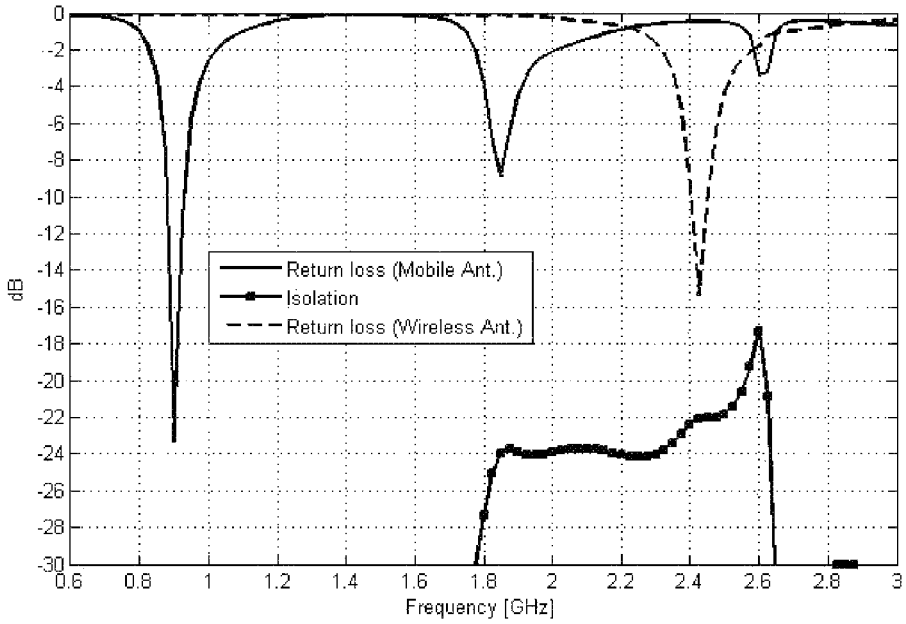

FIGS. 5 (A-B)—Typical electrical performance of the antennas of the handset shown in FIGS. 4 (A-B): (FIG. 5A) Return loss of each antenna and isolation between antennas when the handset is in closed position; and (FIG. 5B) return loss of each antenna and isolation between antennas when the handset is in open position.

Figure 6:
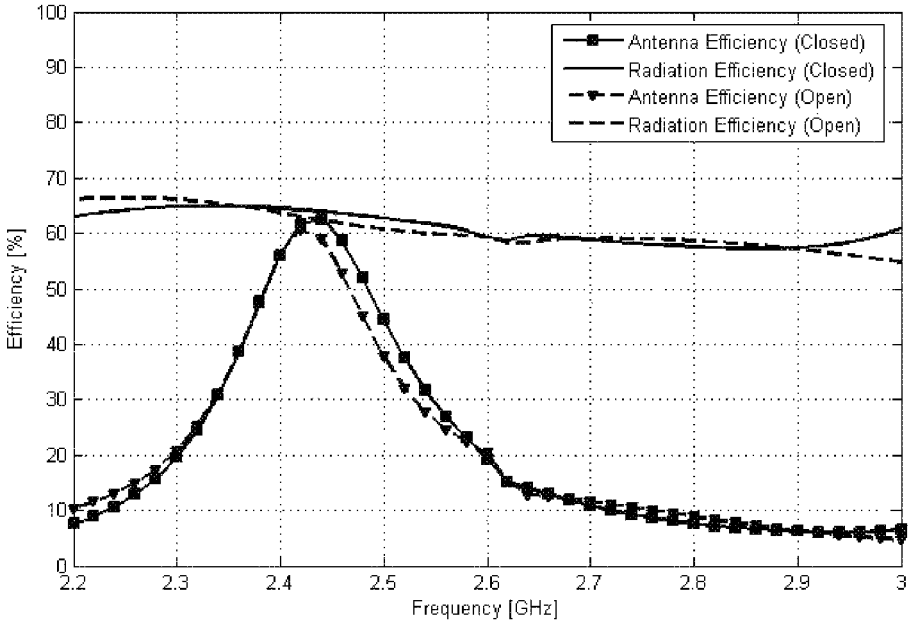

FIG. 6—Typical radiation and antenna efficiency of the slot antenna for wireless connectivity integrated in the handset of FIG. 4.

FIG. 7 (A-I)—Top view of some implementations of the handset comprising a mobile antenna 701 and a slot antenna (black line) 702 on the PCB (700) for wireless connectivity services.

Figure 7A:
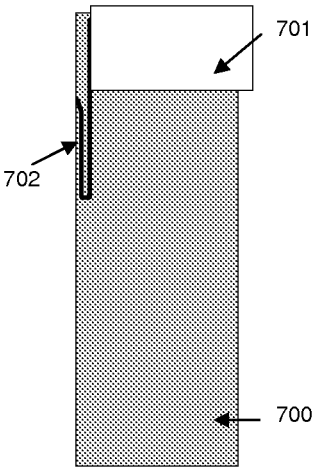
Figure 7B:
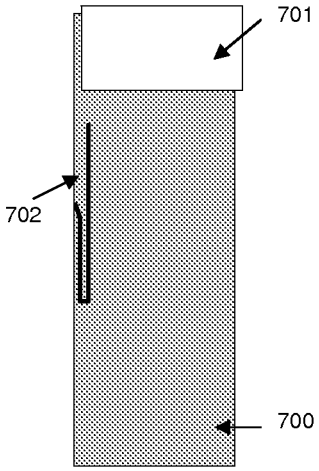
Figure 7C:
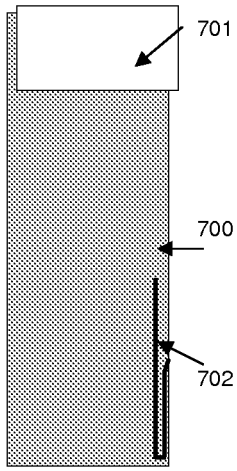
Figure 7D:
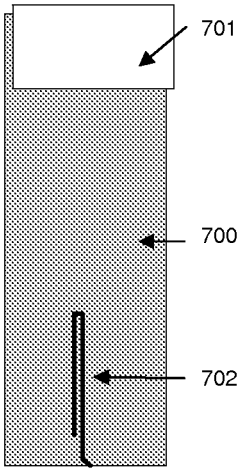
Figure 7E:
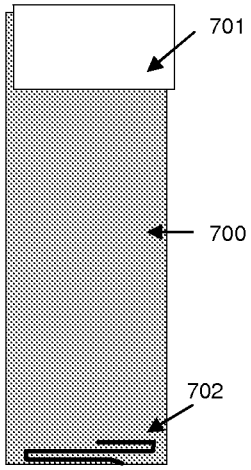
Figure 7F:
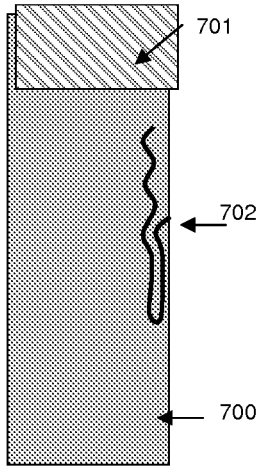
Figure 7G:
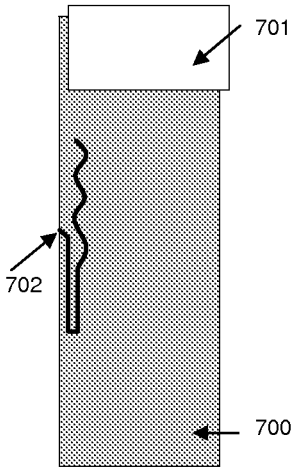
Figure 7H:
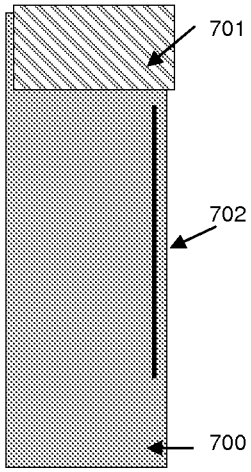
Figure 7I:
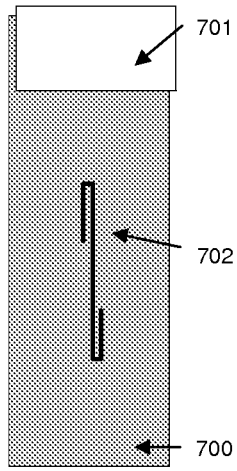
Figure 8A:
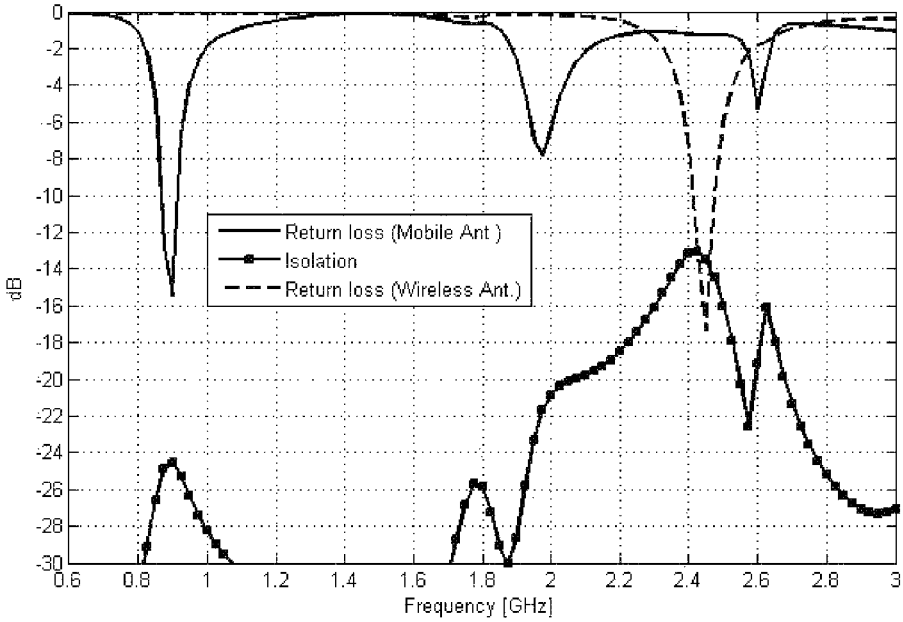
Figure 8B:
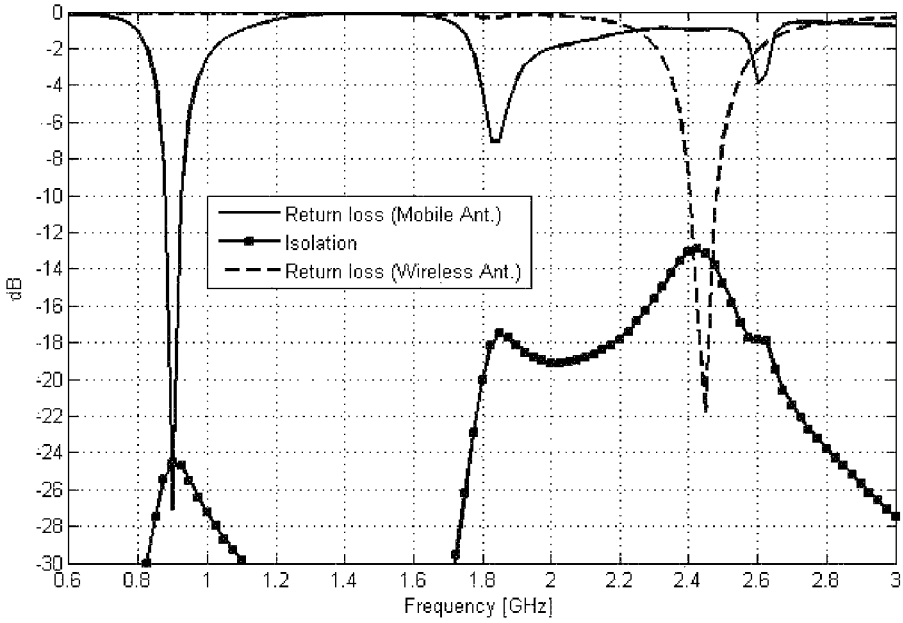

FIGS. 8(A-B)—Typical electrical performance of the antennas of the handset shown in FIG. 7B: (FIG. 8A) Return loss of each antenna and isolation between antennas when the handset is in closed position; and (FIG. 8B) return loss of each antenna and isolation between antennas when the handset is in open position.

Figures 9A, 9B:
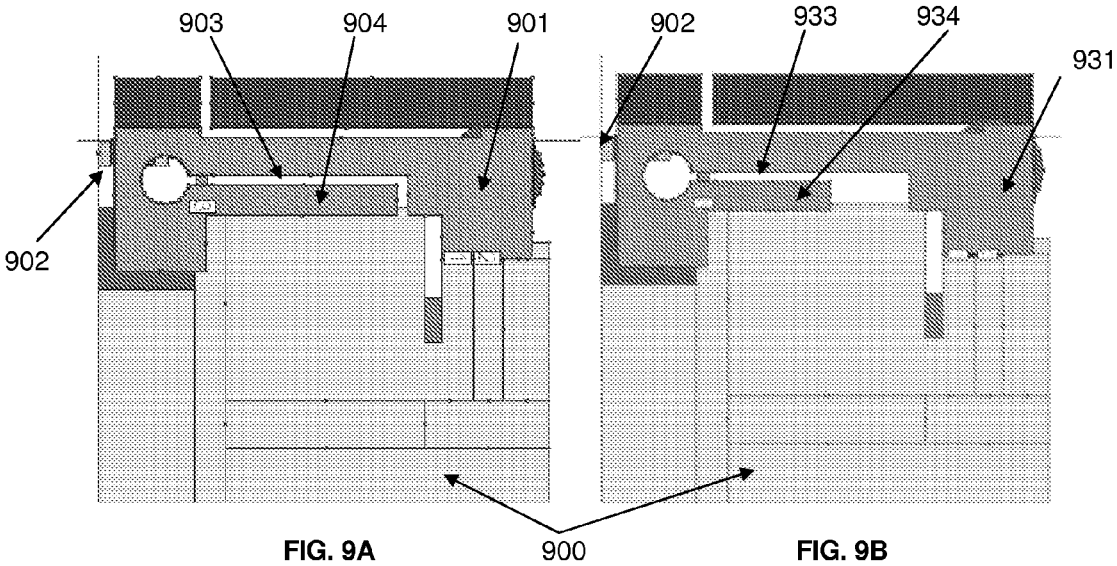
Figure 9C:
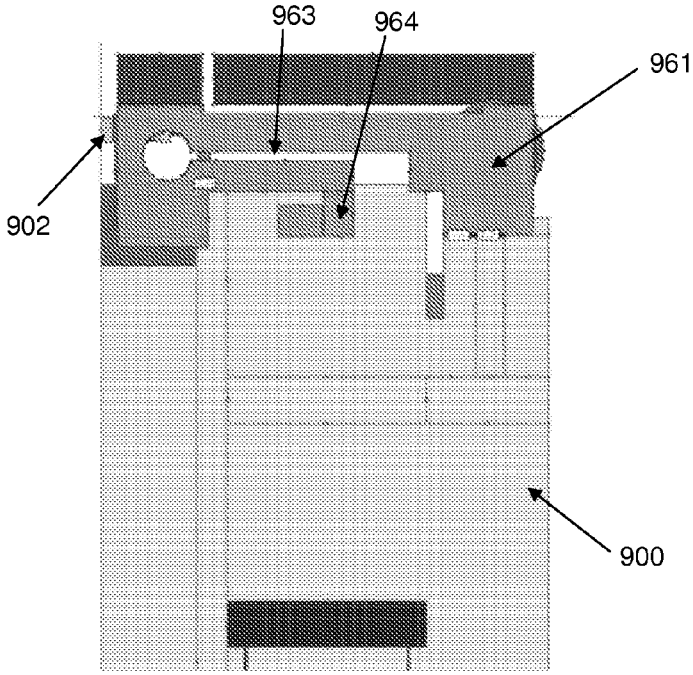

FIGS. 9(A-C)—(FIG. 9A) Detailed view of an example of a handset comprising a first antenna for mobile communications and a second antenna for wireless connectivity services. The geometry of the antenna for mobile communications can be tailored according to the teachings of the present invention to enhance the isolation with the antenna for wireless connectivity services by (FIG. 9B) modifying the dimensions of an arm of the mobile antenna; or (FIG. 9C) folding an arm of the mobile antenna.

Figure 10:
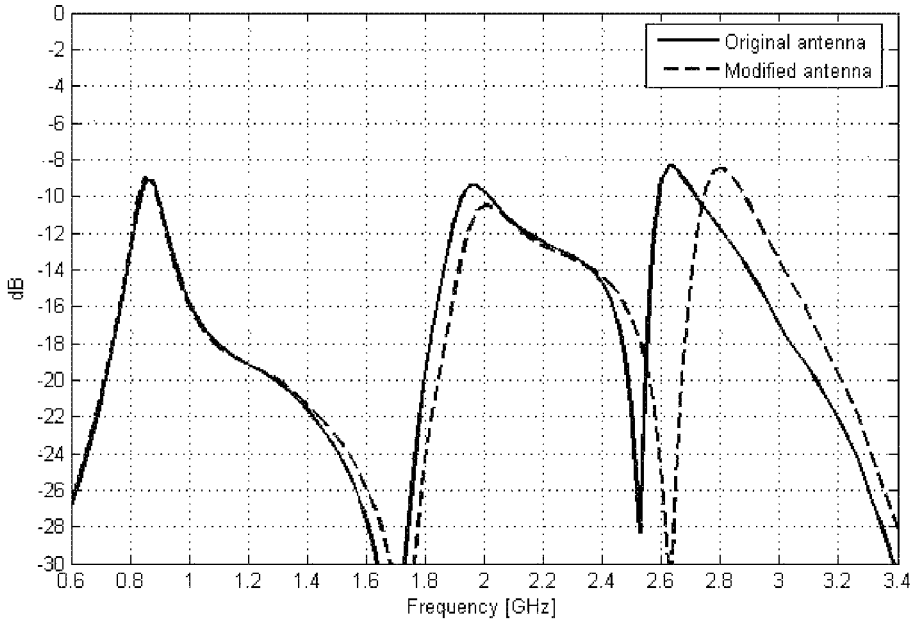

FIG. 10—Comparison of typical levels of isolation between the mobile antenna and the wireless connectivity antenna that can be obtained before and after modifying the mobile antenna as depicted in FIG. 9B.

Figure 11A:
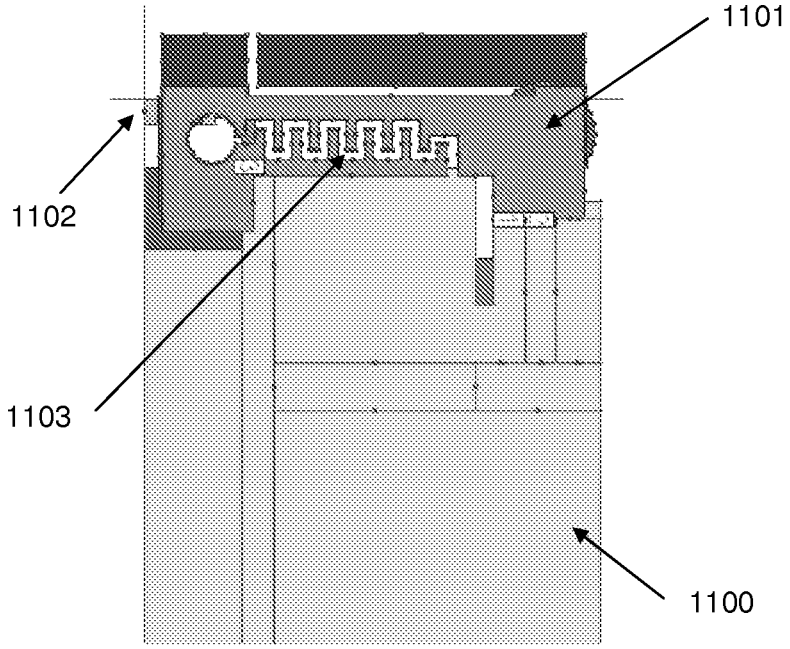
Figure 11B:
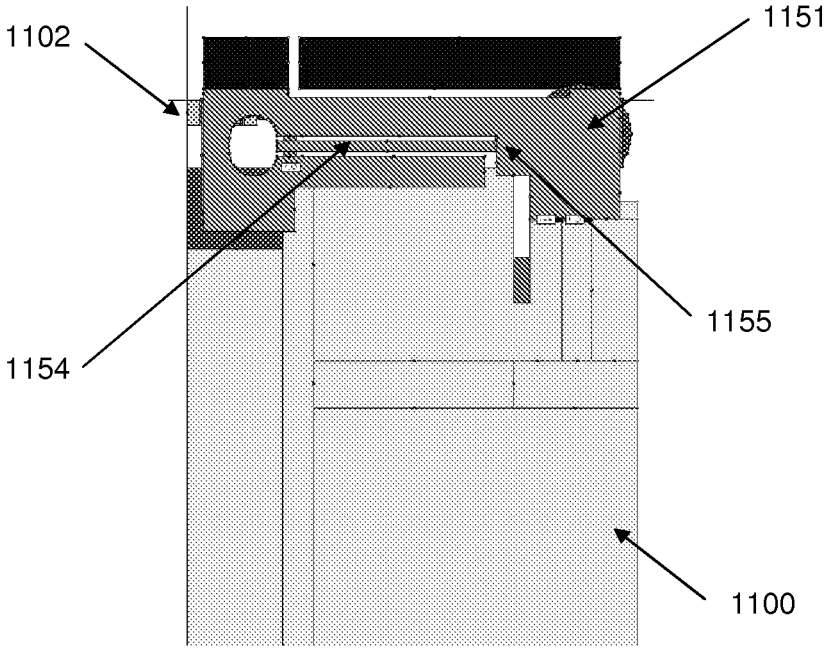

FIGS. 11(A-B)—Detailed view of an antenna for mobile communications whose geometry has been modified according to the teachings of the present invention to enhance the isolation with the antenna for wireless connectivity services by increasing the length of a slot defined in the structure of the mobile antenna by means of: (FIG. 11A) shaping the slot as a meander-like curve; or (FIG. 11B) adding a conductive strip inside the aperture of the slot.

Figure 12:
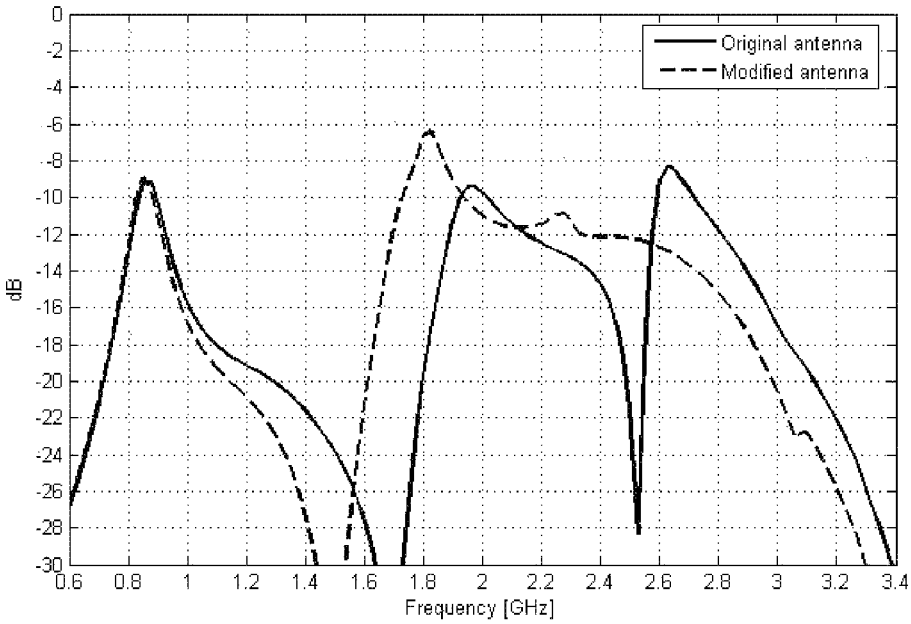

FIG. 12—Comparison of typical levels of isolation between the mobile antenna and the wireless connectivity antenna that can be obtained before and after modifying the mobile antenna as depicted in FIG. 11B.

Figure 13A:
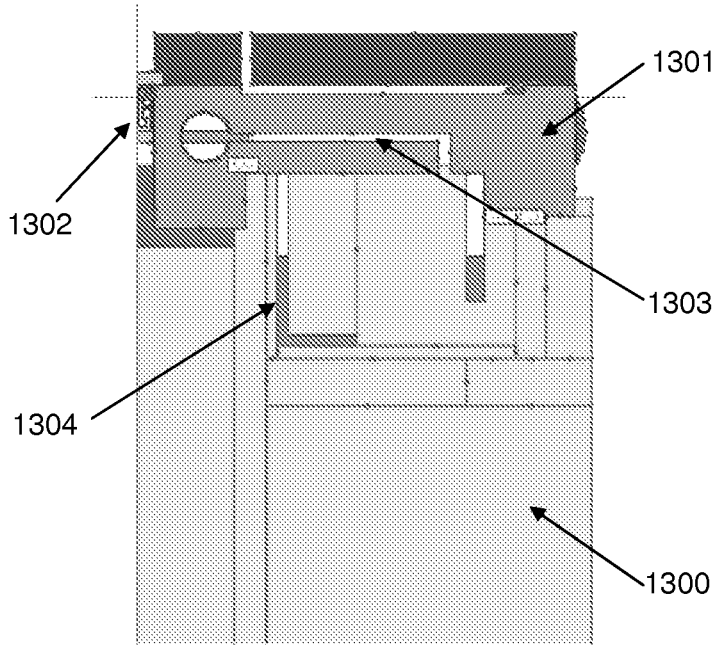
Figure 13B:
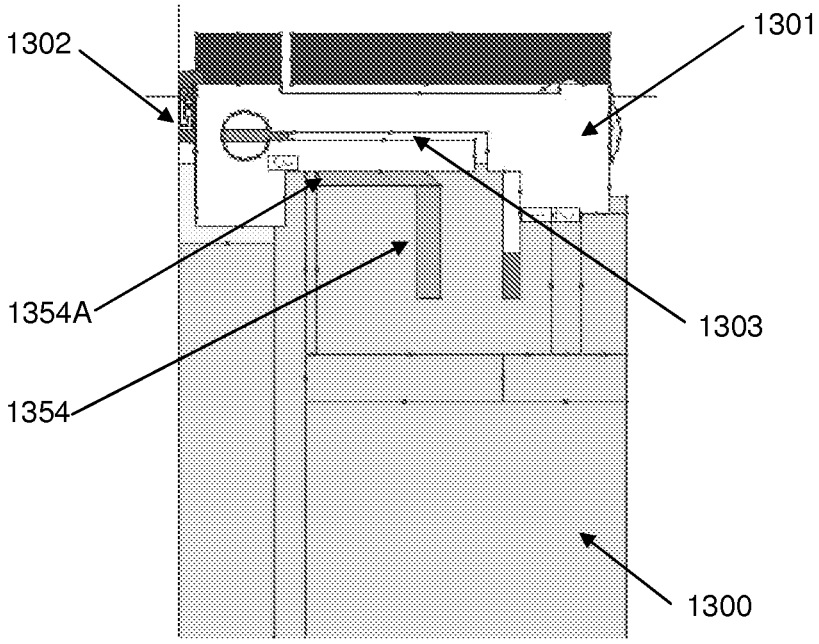

FIGS. 13(A-B)—Detailed view of the top portion of the PCB of a handset showing different embodiments according to the present invention to enhance the isolation between an antenna for mobile communications and an antenna for wireless connectivity services by: (FIG. 13A) introducing a slot on the PCB; or (FIG. 13B) placing a conductive stripe above the PCB that is shorted on one end to the PCB.

Figure 14:
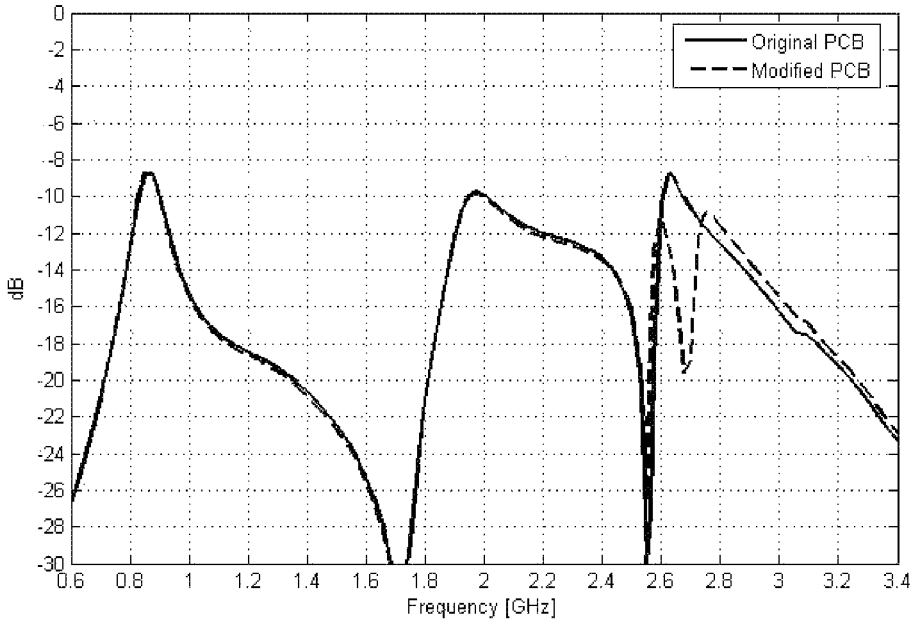

FIG. 14—Comparison of typical levels of isolation between the mobile antenna and the wireless connectivity antenna that can be obtained before and after modifying the PCB of the handset as depicted in FIG. 13B.

Figure 15A:
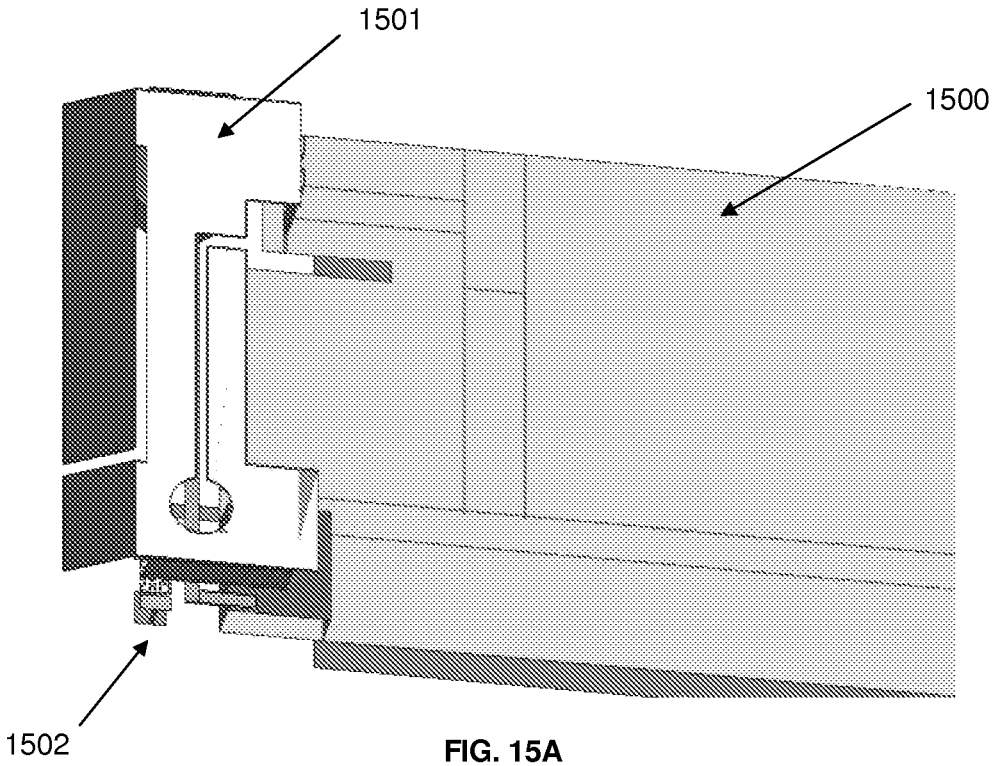
Figure 15B:
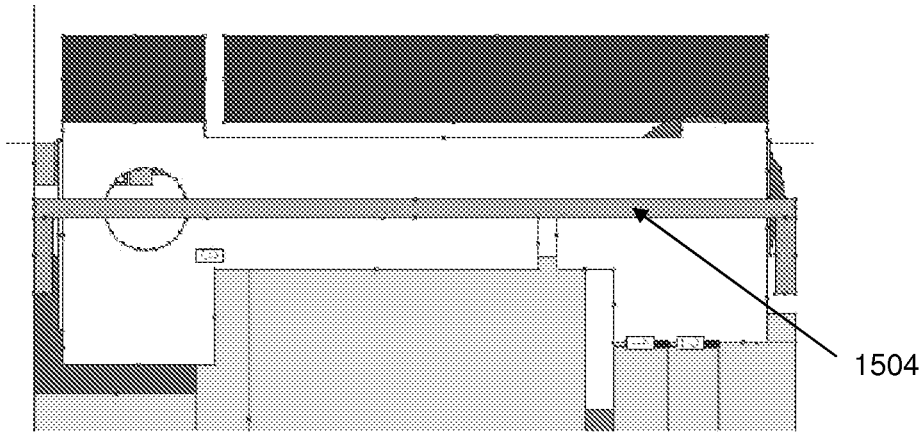

FIGS. 15(A-B)—Embodiment of a handset according to the present invention including a mobile antenna, a wireless connectivity antenna, and parasitic element to enhance the isolation between antennas: (FIG. 15A) General view of the PCB of the handset; and (FIG. 15B) detailed view of the top portion of the PCB of the handset showing the shape of the parasitic element. (For the sake of clarity, in FIG. 15B the parasitic element appears to be above the mobile antenna, although in reality it is placed below the mobile antenna but above the plane of the PCB of the handset, that is, between the mobile antenna and the PCB of the handset.)

Figure 16:
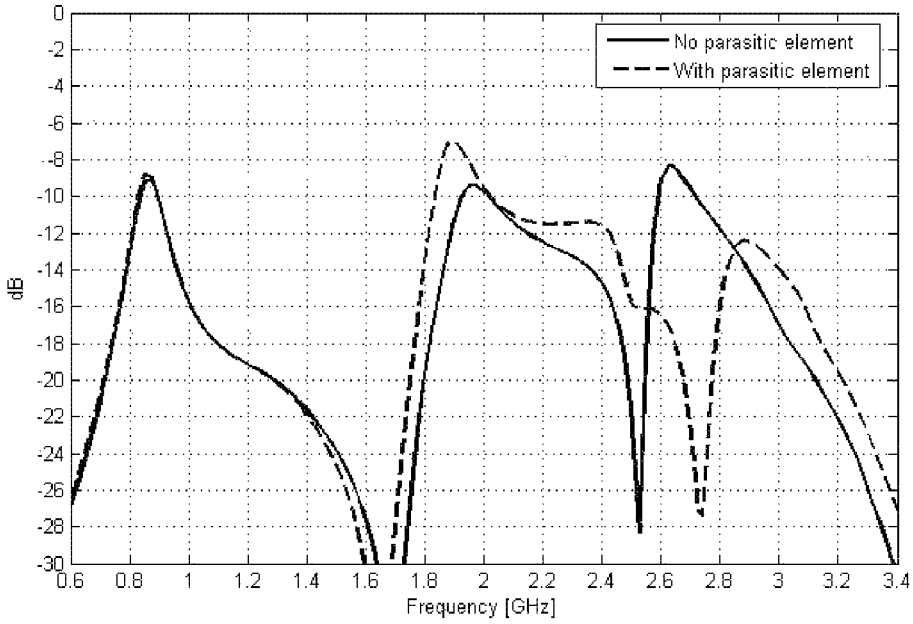

FIG. 16—Comparison of typical levels of isolation between the mobile antenna and the wireless connectivity antenna that can be obtained before and after introducing a parasitic element, like the one shown in FIGS. 15(A-B), in the handset.

Figure 17A:
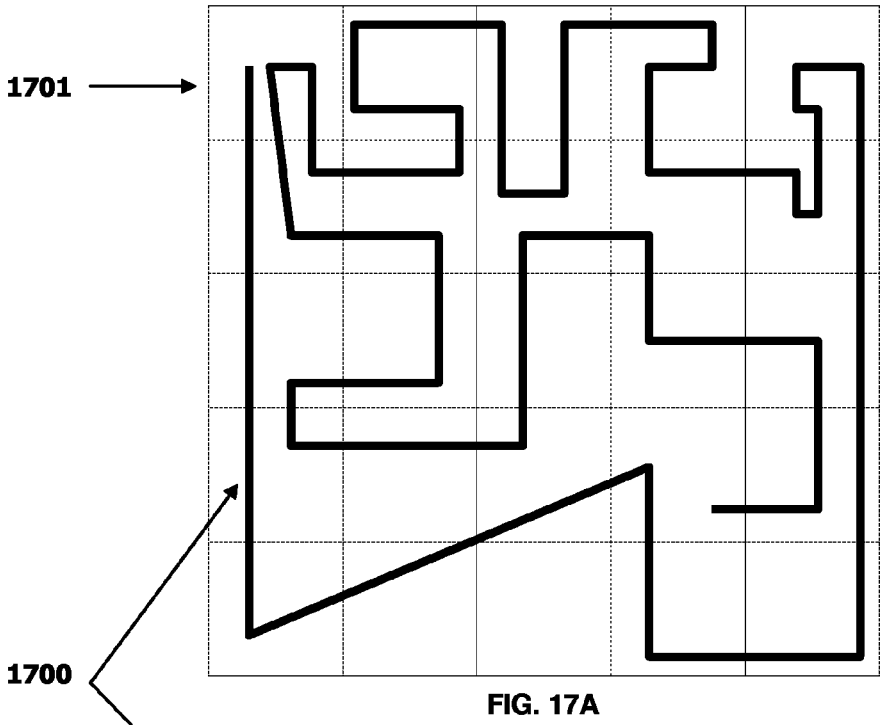
Figure 17B:
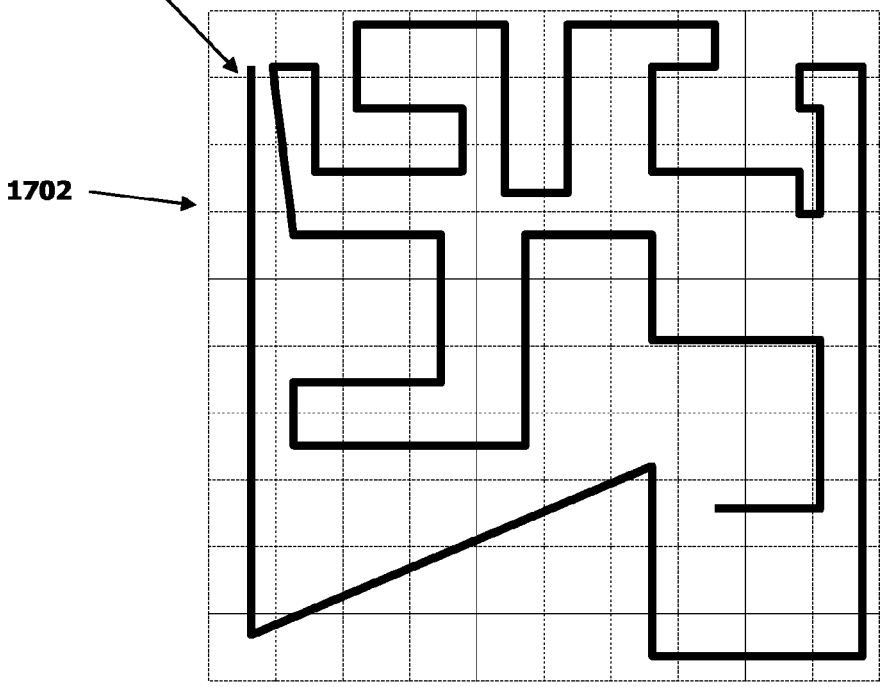

FIGS. 17(A-B)—Example of a box counting curve located in a first grid (FIG. 17A) of 5×5 boxes and in a second grid (FIG. 17B) of 10×10 boxes.

FIG. 18—Example of a grid dimension curve.

FIG. 19—Example of a grid dimension curve located in a first grid.

FIG. 20—Example of a grid dimension curve located in a second grid.

FIG. 21—Example of a grid dimension curve located in a third grid.

FIGS. 22(A-B)—Example of a slot antenna component.

FIGS. 23(A-C)—Different examples of possible locations of a slot antenna component on the circuit board.

DESCRIPTION OF THE PREFERRED EMBODIMENTS

In some preferred embodiments of the handset or handheld device of the present invention, said handset or handheld device comprises a first antenna used for at least one mobile communication service, and a second antenna used for at least one wireless connectivity service, wherein the second antenna is a slot antenna (cf. for example FIGS. 4(A-B)). In the example of FIGS. 4(A-B), and without being a limitation of the invention, the slot (402) has been created in the ground plane of the PCB (400) (namely, in a conductive metal layer of the PCB) on its right hand side and near the bottom (considering a groundplance arranged in the vertical plane and with the mobile antenna 401 at its top end, as illustrated in FIGS. 4(A-B)). The shape of the slot (402), and the length and widths of each one of the segments that form the said slot (402), can be selected to meet the requirements of resonance frequency, electrical performance, and maximum PCB area constraint, of a given handset or handheld device.

In the example of FIGS. 4(A-B), the slot (402) intersects the perimeter of the ground plane of the PCB (400) at one point (406). In other words, the slot (402) is not completely surrounded by conducting materials. In some preferred cases, the unfolded length of the slot (402) will be approximately a quarter of an operating wavelength of the slot antenna. In some other cases, the unfolded length of the slot (402) will be approximately three times, or approximately five times, or approximately another odd integer number of times, the length of one quarter of an operating wavelength of the slot antenna.

In other embodiments, the slot might intersect the perimeter of the ground plane of the PCB on which is placed at least at one point, such as for example at two points. In yet some other embodiments, the slot might not intersect the perimeter of the ground plane of the PCB on which is placed. That is, the slot is in these cases completely surrounded by conducting material (in the layer or layers containing the slot). In some embodiments, it might be advantageous that the unfolded length of the slot be approximately twice, or approximately four times, or approximately another even integer number of times, the length of one quarter of an operating wavelength of the slot antenna.

In order to minimize the coupling between the first antenna (401) and the second antenna (402) (i.e., to maximize the isolation), the design of the slot (402) and its orientation with respect to the PCB (400) is selected such that the slot (402) is substantially parallel to the direction of the currents excited on the PCB (400) by a resonating mode of the first antenna (401), at least on a portion of the PCB (400). In some cases, it is advantageous to design the slot (402) such that it is substantially parallel to the longer side of the conductive layer or ground-plane of the PCB (400), because the currents excited on said PCB (400) by the resonating mode of the first antenna (401) tend to be substantially parallel to said longer side of the PCB (400). In the context of this application, two directions are considered to be substantially parallel if they form an angle of less than, or equal to, approximately 30 degrees. Also in the context of this application, the direction of a slot is defined by the direction of the longest side of the minimum rectangular area in which said slot is or can be inscribed.

In some other cases, the first antenna may include a slot that radiates at a particular resonance frequency, so that said first antenna behaves substantially as a magnetic current source for that resonance frequency. In these embodiments it will be advantageous to align the said slot of the first antenna along a first direction and the slot of the second antenna along a second direction, said first direction being substantially orthogonal to said second direction. In the context of this application, two directions are considered to be substantially orthogonal if they form an angle in the range from approximately 60 degrees to approximately 120 degrees.

The shape of the slot (402) can comprise straight and curved segments, not necessarily all segments being of the same length (see examples in FIGS. 7(A-I)). In the same way, the separation between the conductive edges of each segment of the slot (402) does not have to be the same for all segments, nor constant for any given segment (i.e., any segment of the slot (402) can be tapered).

In some examples, the slot (402) might have one, two, three, or more bends. In general, as the number of bends in the slot (402) increases, the shape of the slot (402) becomes more and more convoluted, leading to a higher degree of miniaturization of the resulting slot antenna.

In some cases, the slot antenna can advantageously be excited by applying a voltage difference between the opposite conductive edges of the slot (402) at a particular point (408) along the geometry of the slot (hereinafter referred to as the feeding point). In some embodiments, the feeding point (408) will be closer to the closed end of the slot (407) than to the open end of the slot (406). In certain examples, the distance between the feeding point (408) and the closed end of the slot (407) will be less than, or equal to, 0.2%, 0.4%, 0.8%, 1.2% 1.6%, 2.5%, 3.3%, 4% or 8% of a free-space operating wavelength of the slot antenna.

In some examples, it will be advantageous to have the slot antenna (402) inscribed in a rectangular area (403) of width (405) smaller than 1/50 of the free-space operating wavelength of the slot antenna (402), and length (404) smaller than 1/4 of the free-space operating wavelength. Being more general, in some embodiments the said width (405) divided by the free-space operating wavelength of the slot antenna will be smaller than, or equal to, at least one of the following fractions: 1/10, 1/30, 1/50, 1/60, 1/70, or 1/80. In the same way, for some embodiments, said length (404) divided by the free-space operating wavelength of the slot antenna can be smaller than, or equal to, at least one of the following fractions: 1/2, 1/3, or 1/4. In some other instances, it will be advantageous that the sum of the length (404) and the width (405) of the rectangular area (403) in which the slot is inscribed be smaller than 1/2 of the free-space operating wavelength, or even smaller than 1/4 of the free-space operating wavelength. Furthermore, it will be advantageous in some cases that the separation between the two edges of the slot (402) be within a range from approximately 0.08% of the free-space operating wavelength to approximately 8% of a longest free-space operating wavelength, including any subinterval of said range.

FIGS. 5(A-B) presents, without any limiting purpose, an example of electrical results for the handset of FIGS. 4(A-B) according to the present invention. FIG. 5A presents typical values of the input parameters of the antennas (i.e., return losses of each antenna, and isolation between antennas) when the slider-type phone is in the closed position, while FIG. 5B presents the typical results of the antennas when the phone is in the open position. In this example, the first antenna (401) was designed to have a multiband behavior, with a first resonance around 900 MHz to provide coverage for the GSM900 service, and a second resonance around 1900 MHz to provide service under the GSM1800 and GSM1900 standards. On the other hand the second antenna was designed to be tuned in the 2500 MHz band. The isolation between the first antenna (401) and the second antenna (402) exceeds 30 dB in the 900 MHz band, is better than 23 dB in the 1900 MHz band, and better than 21 dB in the 2500 MHz band. The level of isolation attained between the antennas of the example shown in FIGS. 4(A-B) is better than the results obtained for the example of a conventional prior-art arrangement in FIG. 2. A typical radiation performance of the slot antenna (402) is shown without any limiting purpose in FIG. 6. The slot antenna (402) has a level of radiation efficiency in excess of 60% in its band of operation both in the open and closed positions of the handset.

FIGS. 7(A-I) present, without any limiting purpose, some embodiments for the present invention of a handset or handheld device comprising a slot antenna. Generally, it will be preferable to keep the separation between the mobile antenna (701) and the wireless connectivity antenna (702) as large as possible in order to maximize the isolation between the antennas. For example, isolation between the antennas on the PCB for the case of FIG. 7C is expected to be better than for the case of FIG. 7A, as the separation between the antennas is larger. However, in certain embodiments it may not be possible to place the mobile antenna (701) and the wireless connectivity antenna (702) further apart. In these cases it will be especially necessary or convenient to use additional techniques to further improve the isolation between the mobile antenna and the wireless connectivity antenna by acting either on the geometry of the mobile antenna, or on the PCB of the handset or the handheld device, or on both.

The electrical performance of the antennas in the embodiment of FIG. 7B is presented without any limiting purpose in FIGS. 8(A-B). As it can be observed, the return loss of each antenna is practically the same as the one already presented in FIGS. 5(A-B). However, there is a degradation in the isolation between the mobile antenna (701) and the wireless connectivity antenna (702), predominantly around 2400 MHz, linked to the smaller separation between the antennas.

Another aspect of the invention relates to techniques to enhance the isolation between the mobile antenna and the wireless connectivity antenna. Some of these techniques comprise the steps of shaping the geometry of the mobile antenna to eliminate higher order resonant modes or spurious modes that may fall within an operating band of the wireless connectivity antenna (or vice-versa), giving rise to strong coupling of the mobile antenna with the wireless connectivity antenna.

In some embodiments, the mobile antenna can comprise features (such as, for instance, a slot, or a strip of metal) with an electrical length close to approximately an integer multiple of a quarter of an operating wavelength of the wireless connectivity antenna. For example, in the embodiment of FIG.

9A, the mobile antenna (901) comprises a slot (903) that has a length of approximately a quarter of the wavelength at 2600 MHz, corresponding to an operating band of the wireless connectivity antenna. For the purposes of this example and the following ones, a wireless connectivity antenna (902) (for example, embodied in a slot antenna component) has been placed near the top left corner of the PCB (900) underneath the mobile antenna (901). As commented previously, this is not a particularly advantageous position for the wireless connectivity antenna (902), as the little distance with respect to the mobile antenna (901) can imply poor isolation. As it can be seen in FIG. 10, a typical level of isolation between antennas at 2600 MHz is approximately 8 dB. However, this antenna arrangement will help to illustrate the improvement in isolation between antennas that can be achieved by following the teachings disclosed in this patent application.

In order to increase the isolation between antennas, the length of the slot (903) can be shortened to force the associated resonance frequency to move towards higher frequencies, away from the wireless connectivity band. In the embodiment illustrated in FIG. 9B, the conducting arm of the mobile antenna (934) has been shortened by some amount with respect to the original arm (904), so that the resulting slot (933) is shorter or substantially shorter than a quarter of the relevant resonant wavelength of the wireless connectivity antenna and therefore resonates at a higher frequency.

The resonance frequencies of the mobile antenna (931) might shift in frequency as a consequence of the shortening of the conducting arm (934). The operating bands of the mobile antenna (931) can be readily retuned using for example a matching network at the feeding point of the antenna. As an alternative, it can be preferred to lengthen the arm (934) to retune the operating bands of the mobile antenna (931), while keeping the length of slot (933) constant. In that sense, the embodiment in FIG. 9C shows a mobile antenna (961) in which the conducting arm (964) has been folded as a U shape, while ensuring that the length of the slot (963) is shorter than that of the slot (903) in FIG. 9A. In this case, the end of the conducting arm (964) does not coincide with the open end of the slot (963), as it was the case of embodiment in FIG. 9A, where the tip of arm (904) defined the open end of the slot (903). FIG. 10 presents without any limiting purpose a typical antenna isolation that can be obtained with a modified mobile antenna like the one in FIG. 9C, and compares it with the isolation obtained with the original mobile antenna (FIG. 9A).

In some cases, in order to achieve a good improvement in isolation between antennas, the length of a slot, or a conducting strip, or more generally a geometric feature of the mobile antenna which has an associated resonance within a band of the wireless connectivity antenna, will be modified (i.e., shortened or enlarged) about 12%, or about 20%, or even about a 30%, of the original length of said slot, or said conducting strip, or said geometrical feature of the mobile antenna.

In some other embodiments it can be advantageous to increase a dimension of a feature of the mobile antenna with an associated resonance at a frequency within an operating band of the wireless connectivity antenna. FIGS. 11(A-B) discloses two embodiments of a handset comprising a mobile antenna and a wireless connectivity antenna that use this technique to improve the antenna isolation. In the case of FIG. 11A, the slot (903) in the original mobile antenna (901) has been replaced by a meander-like slot (1103) to make it electrically longer and shift the resonance associated to this slot (1103) well below the operating band of the wireless antenna (1102). In some embodiments of the present invention at least a portion of the slot (1103) will be preferably shaped as a space-filling curve, a box-counting curve, a grid-dimension curve, or a fractal based curve, to achieve maximum size compression.

The embodiment in FIG. 11B illustrates another way of increasing the electrical length of the slot (903) of the original mobile antenna (901). In this case, the mobile antenna (1151) comprises a metal strip (1154) that is placed between the edges of the slot (903) and shorted at one end to the main body of the mobile antenna (1151) in the region (1155). In certain cases, the metal strip (1154) will be long enough to cover substantially the slot (903), while in other cases the metal strip (1154) will be shorter and be placed in just a portion of the slot (903). The resulting "U-shaped" slot will have an associated resonance frequency lower than that of the original slot (903). FIG. 12 presents without any limiting purpose a typical antenna isolation that can be obtained with a modified mobile antenna like the one in FIG. 11B, and compares it with the isolation obtained with the original mobile antenna (FIG. 9A). In some embodiments, such a technique improves the isolation by 4 dB or more.

Some other techniques to enhance the isolation between the mobile antenna and the wireless connectivity antenna in a handset or handheld device according to the present invention comprise the steps of modifying the geometry of the PCB of said handset or handheld device to introduce on said PCB a feature able to increase the isolation between antennas in a particular frequency band.

FIG. 13A presents an embodiment of a handset comprising a mobile antenna (1301), a wireless connectivity antenna (1302) and a PCB (1300), wherein a slot (1304) has been created in a ground plane of said PCB (1300). The slot (1304) features an open end. That is, the slot (1304) intersects the perimeter of the conducting pattern of the PCB (1300) in at least one point. In other words the slot (1304) is not completely surrounded by conducting materials. In this example, the unfolded length of the slot (1304) has been selected to be approximately a quarter of the wavelength at the frequency for which the isolation between antennas needs to be enhanced. More generally, the length of the slot (1304) can be adjusted to be approximately an odd integer multiple of a quarter of the wavelength at the frequency for which a higher level of isolation is needed.

A purpose of the slot (1304) is to present a high impedance path to the currents flowing on the perimeter of the ground plane of the PCB (1300) on which the slot (1304) is placed and/or along a preferred path between the feeding points of the first and second antennas (the feeding point of said second antenna (1302) is placed under the first antenna (1301), at the left of the slot (1304) in FIG. 13A). Therefore, it will be preferred in certain embodiments, in order to increase the isolation, to place the slot (1304) at a point along the perimeter of the ground plane of the PCB (1300) in which the currents flowing from the wireless connectivity antenna (1302) towards the mobile antenna (1301) along the perimeter of the ground plane of the PCB (1300) are strong. In other embodiments, a purpose of shaping the ground plane with for instance one or more slots is to alter the phase and amplitude of the coupling and to generate multiple signal coupling paths such that those multiple signals cancel or partially cancel each other.

FIG. 13B discloses another embodiment of a handset comprising a mobile antenna (1301), a wireless connectivity antenna (1302) and a PCB (1350), wherein a conductive stripe (1354) has been placed above, and substantially parallel to, the ground plane of the said PCB (1350) and shorted at one end to the said PCB (1350). In the example of the figure, the unfolded length of the conducting stripe (1354) has been selected to be approximately a quarter of the wavelength at the frequency for which the isolation between antennas needs to be enhanced. Being more general, the length of the conducting stripe (1354) can be adjusted to be approximately an odd integer multiple of a quarter of the wavelength at the frequency for which a higher level of isolation is needed.

Similarly to the slot (1304) in FIG. 13A, a purpose of the conducting strip (1354) is to present a high impedance path to the currents flowing on the ground plane of the PCB (1350) from the wireless connectivity antenna (1302) towards the mobile antenna (1301) (or viceversa). Therefore, it will be advantageous in some cases, to place the shorted end of the conducting stripe (1354) at least a distance of approximately a quarter of the wavelength at the frequency for which a higher level of isolation is needed, on the path that the currents flowing from the wireless connectivity antenna (1302) towards the mobile antenna (1301) follow on the ground plane of the PCB (1350) (or viceversa).

FIG. 14 presents, without any limiting purpose, typical antenna isolation that can be obtained by using a handset with a modified PCB as the one disclosed in FIG. 13B. Compared with the isolation curve obtained in the original handset (FIG. 9A), the presence of the shorted conducting strip (1354) introduces a deep notch in the isolation in the region between 2600 MHz and 2800 MHz, where the original handset had a poor isolation.

In other embodiments, the ground plane of the PCB of the handset or handheld device can have two or more slots, like the slot (1304) in FIG. 13A, or two or more conducting strips shorted to the ground plane of the PCB, like the conducting stripe (1354) in FIG. 13B. By adjusting the number and length of the slots or the conducting strips, the frequency behavior of the isolation between antennas can be tailored. In general, for a wide-band behavior, the length of the slots or the conducting strips will be substantially similar. For a multiband response with no overlapping between frequency bands, the length of each slot or each conducting strip is associated mainly with the center frequency of a particular band at which the isolation between antennas needs to be increased. In yet other embodiments, a single slot (or a single conducting strip) with multiple branches can be used to obtain an improvement in the isolation with a wideband or multiband behavior.

In yet other embodiments, the handset or handheld device comprises a mobile antenna (1501), a wireless connectivity antenna (1502), and a conducting strip (1504) placed in the vicinity of the mobile antenna (1501) and the wireless connectivity antenna (1502), but differently from what is disclosed in FIG. 13B, said conducting strip (also referred to as parasitic element) is not connected to the ground plane of the PCB (1500). In the example of the FIG. 15(A-B), the unfolded length of the conducting strip (1504) has been selected to be approximately half of the wavelength at the frequency for which the isolation between antennas needs to be enhanced. The resonance introduced by said conducting strip (1504) enhances the curve of isolation between antennas (see FIG. 16, which is provided for the purposes of illustration only and in no way meant as a definition of the limits of the invention), improving substantially the isolation in the desired band (the 2600 MHz-2800 MHz region in this particular example). This conductive strip (1504) basically functions as a shield for the electromagnetic radiation between the two antennas.

In some embodiments of the present invention (see for example FIGS. 13(A-B) and 15(A-B)) at least a portion of the slot (1304), or a portion of the conducting strip (1354, 1504) will preferably be shaped as a space-filling curve, a box-counting curve, a grid-dimension curve, or a fractal based curve, to achieve maximum size compression.

A person skilled in the art will recognize that the techniques disclosed in this patent application can be advantageously used to enhance the isolation between an antenna for mobile communications and an antenna for wireless connectivity services not only when the latter is a slot antenna but also for other types of antenna topology such as for instance, but not limited to, a monopole antenna, an IFA, a patch antenna or a PIFA.

Figure 22A:
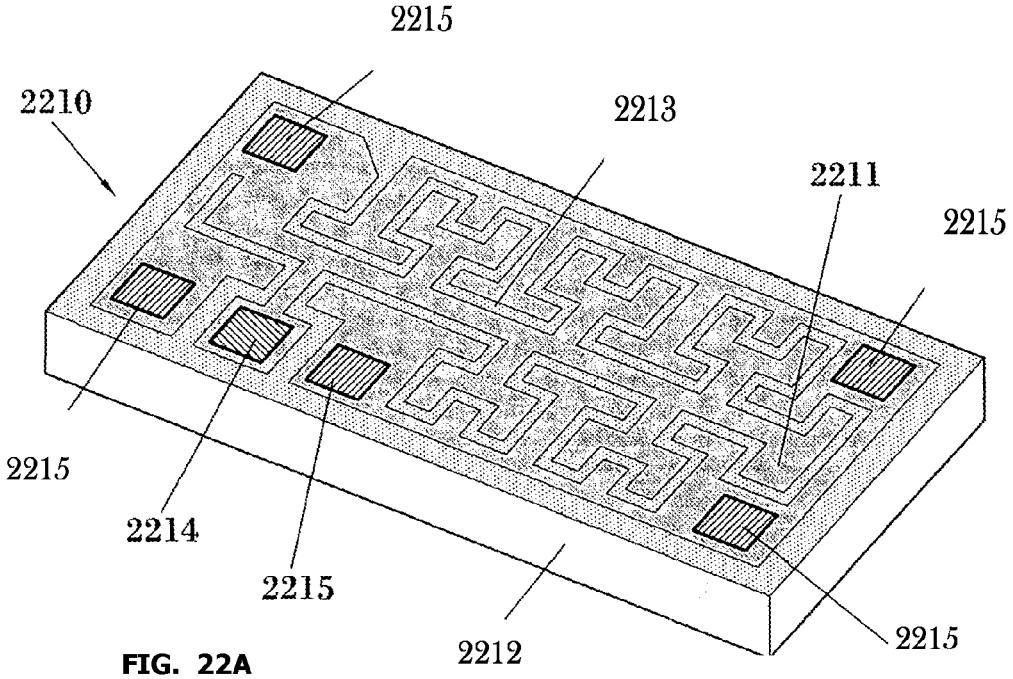
Figure 22B:
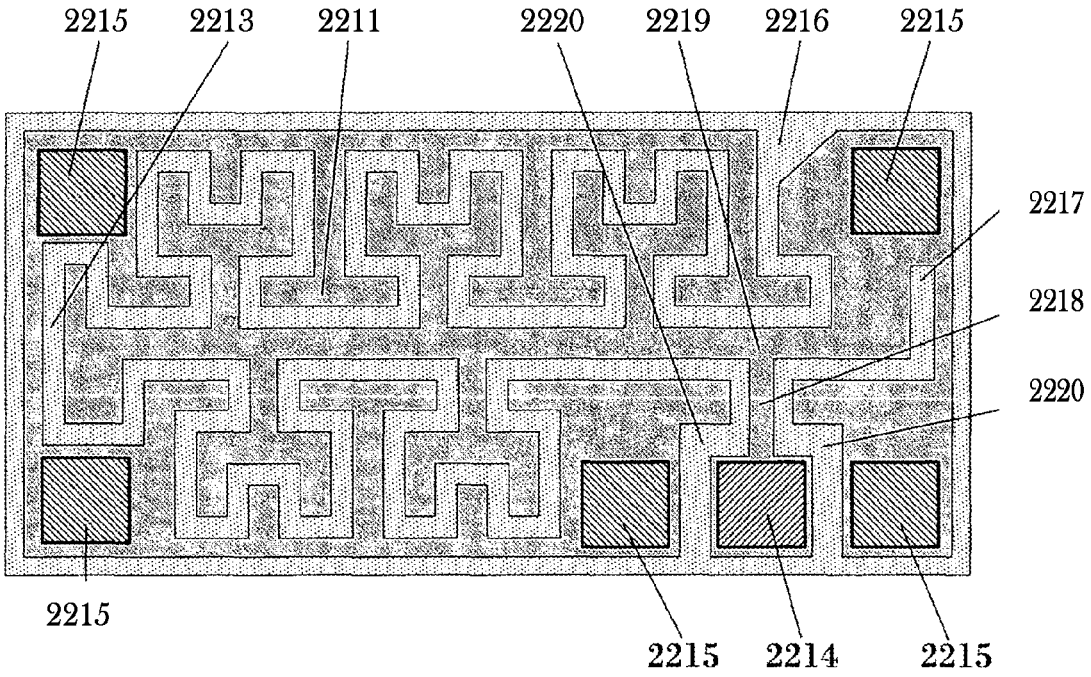

Figs. (A-B) shows an example of slot-antenna component 2210 according useful for present invention, including a conductive surface 2211, in which a slot 2213 has been created, a dielectric substrate 2212, five grounding terminals 2215 and feeding means comprising a feeding terminal 2214. In FIG. 22A a perspective bottom view of the slot-antenna component (i.e., as seen from the side of the component facing the PCB on which it is to be mounted) is shown. FIG. 22B is a top view of the component (i.e., as seen from the side of the component not facing the PCB on which it is to be mounted).

The conductive surface 2211 is backed by a dielectric substrate 2212. In this particular embodiment, and without limiting purposes, the contour of the slot 2213 is inspired in the Hilbert curve; however, other shapes could also be used. In fact, the shape of the slot 2213, and the length and width of each one of the segments that form said slot 2213, can be selected to meet the requirements of resonance frequency, electrical performance, and maximum size, of a given SMT component.

In a preferred embodiment, the conductive surface 2211 is covered by another dielectric layer (such as for example a layer of ink, or a layer of protective epoxy coating for environmental protection), in which some windows are left in order to create one or more contact terminals 2214, 2215 of the component 2210. In FIGS. 22(A-B), the slot-antenna component 2210 comprises one feeding terminal 2214 and several grounding terminals 2215. The contact terminals 2214, 2215 have been depicted as square pads, although they could be shaped differently, or take the form of pins or BGA balls.

All contact terminals 2214, 2215 are arranged on or close to the edge of the conductive surface 2211 and at the same time on or close to the edge of antenna component 2210.

In FIGS. 22(A-B), the feeding means of the slot-antenna component 2210 comprise a feeding contact 2214 and a conductive strip 2218 that can be advantageously printed or etched on the same conductive surface 2211 as the slot 2213, thus making the feeding means coplanar with the slot 2213. The conductive strip 2218 connects the feeding terminal 2214 with the edge of the slot 2213 that is farther from the contact terminal 2214 in region 2219 along the slot 2213. In the example of FIG. 12, the connection of the conductive strip 2218 with the edge of the slot 2213 that is farther from the contact terminal 2214 occurs at a substantially right angle (i.e., an angle of approximately 90°), however said connection could also occur at angles smaller or larger than 90°.

In said region 2219, the edge of the slot 2213 that is closer to the feeding terminal 2214 is interrupted, so that the conductive strip 2218 can cross the slot 2213 reaching the farther edge of said slot 2213. A clearance region 2220 is created at both sides of the conductive strip 2218 and the feeding terminal 2214. The width of the clearance region 2220 does not need to be necessarily the same on both sides of the conductive strip 218 and the feeding terminal 2214. The input impedance of the slot antenna can be appropriately selected by means of the distance of the region 2219 to an end of slot 2217, the width of the conductive strip 2218 and the widths of the clearance region 2220 on each side of the conductive strip 2218, and the feeding terminal 2214.

In certain embodiments, said widths can be substantially equal. In some cases, the width of the conductive strip 2218 and the widths of the clearance regions on each side thereof can be advantageously selected so as to form a coplanar transmission line. The width of the conductive strip 2218 and the widths of said clearance regions will preferably be smaller than a maximum width. Some possible values for said maximum width comprise 1/2400, 1/1200, 1/800, 1/600, 1/480, 1/400, 1/300, 1/240, 1/200, 1/150 and 1/120 of a free-space operating wavelength of the slot antenna.

In some cases, it will be advantageous to place a grounding terminal 2215 at each side of the feeding terminal 2214. In other examples, the feeding terminal 2214 might not be coplanar with the slot 2213, making it necessary to couple a feeding signal from the feeding terminal 2214 to the conductive strip 2218 either by direct contact (such as for instance by means of a via hole), or by electromagnetic coupling (either capacitive or inductive). Capacitive (or inductive) coupling can be preferred in some cases to compensate for an inductive (or capacitive) component of the input impedance of the slot antenna, without having to use external circuit elements such as capacitors or inductors.

FIGS. 22(A-B) shows an example of the slot-antenna component 2210 in which the slot antenna is excited in an unbalanced manner. In some other examples, a slot-antenna component could be excited in a balanced manner by including a first feeding terminal to provide a positive potential (referenced to a ground potential) and a second feeding terminal to provide a negative potential (referenced to said ground potential). In some cases, the component can also include a third feeding terminal to provide said ground potential.

In the embodiment of FIGS. 22(A-B), the slot 2213 has a first end 2216 that intersects the perimeter of the conductive surface 2211. That is, the slot 2213 is open-ended at said first end 2216. Furthermore, the second end 2217 of the slot does not intersect the perimeter of the conductive surface 2211 (i.e., it is closed-ended).

Figure 23A:
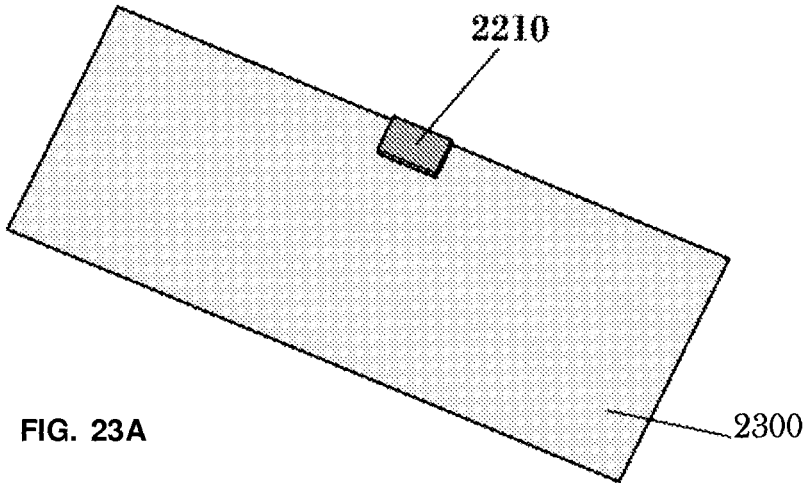
Figure 23B:
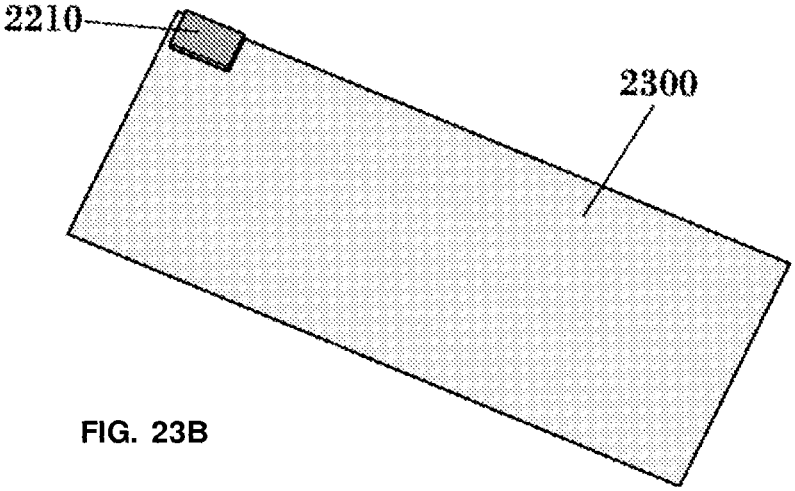
Figure 23C:
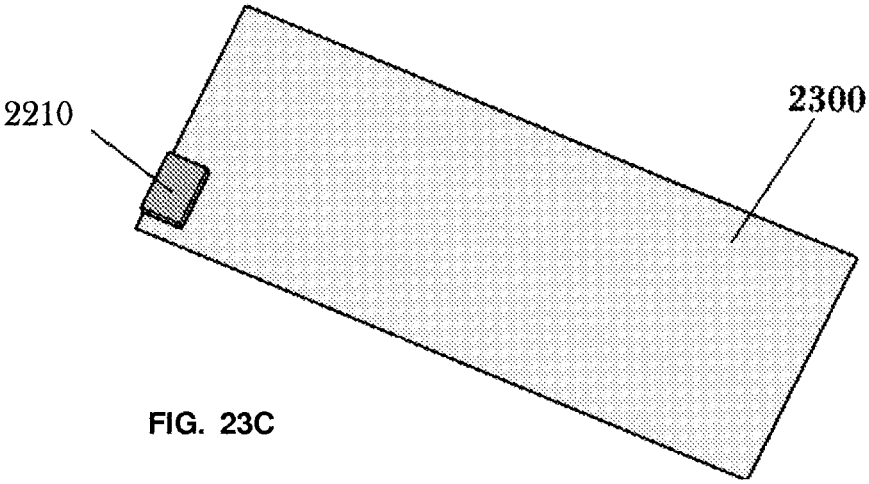

In FIGS. 23(A-B) examples of how a slot-antenna component 2210 can be placed on a substantially rectangular PCB 2300 of a wireless (e.g. handheld or portable) device are shown. In FIG. 23A the longer dimension of the slot-antenna component 2210 is aligned with one of the longer edges of the PCB 2300, and substantially centered along said edge. FIG. 23B relates to the case where the longer dimension of the slot-antenna component 2210 is aligned with one of the longer edges of the PCB 2300, and substantially close to a corner of said edge and in FIG. 23C the longer dimension of the slot-antenna component 2210 is aligned with one of the shorter edges of the PCB 2300, and substantially close to a corner of said edge. It may also be centered along the short edge.

In FIGS. 23(A-C), the conductive layer of the PCB 2300 has been removed or, at least, partly removed under the slot-antenna component 2210, that is, in correspondence with the footprint of the slot-antenna component on the PCB, that is, in correspondence with its projection on the PCB 2300.

Generally, the present invention can facilitate the integration of the antennas inside several kinds of handsets or handheld devices so that the antennas can be arranged in a way that it is compatible with high density of components on the PCB of the device. For miniaturization purposes, at least a portion of the curve defining the conducting trace, conducting wire or contour of the conducting sheet of at least one antenna of the handset or handheld device will advantageously be a space-filling curve, a box-counting curve, a grid-dimension curve, or a fractal based curve. The conducting trace, conducting wire or contour of the conducting sheet of said at least one antenna might take the form of a single curve, or might branch-out in two or more curves, which at the same time in some embodiments will be also of the space-filling, box-counting, grid-dimension, or fractal kinds. Additionally, in some embodiments a part of the curve will be coupled either through direct contact or electromagnetic coupling to a conducting polygonal or multilevel surface.

The teachings disclosed in the present patent application facilitate the adoption of the wireless functionality in handsets and other handheld devices. Handset and handheld device manufactures will benefit from the commercialization of such products with value-added features and that enjoy of stronger customer preference. In a platform like the one of a handset for mobile communications in which the efficient use of small-sized PCBs is paramount, the integration of a wireless connectivity antenna according to the present invention offers the benefit of small area overheads (i.e., smaller overall size of the handheld device), which translates into lower cost. Moreover, the enhanced isolation between antennas attainable using the techniques and teachings of the present invention provide handset and handheld device manufacturers with more flexibility when designing the layout of the PCB of the devices and the placement of the antennas and neighboring electronics on the PCB of the devices, reducing the costs of integration of the antenna, simplifying the new product development cycle, and accelerating the time to market of their new products.

In some preferred embodiments the handset or handheld device is operating at one, two, three or more of the following communication and connectivity services: GSM (GSM850, GSM900, GSM1800, American GSM or PCS1900, GSM450), UMTS, WCDMA, CDMA, Bluetooth™, IEEE802.11ba, IEEE802.11b, IEEE802.11g, WLAN, WiFi, UWB, ZigBee, GPS, Galileo, SDARs, XDARS, WiMAX, DAB, FM, DMB, DVB-H.

What is claimed is:

1. A wireless handheld or portable device comprising:

a ground plane;

the ground plane is inscribed in a rectangular area comprising a first side and a second side, a length of the second side being greater than a length of the first side;

a first antenna configured to transmit and receive electromagnetic waves corresponding to at least three frequency bands;

the at least three frequency bands being used for mobile communication services;

a second antenna configured to receive electromagnetic waves corresponding to at least one frequency band;

the at least one frequency band being used for wireless connectivity services;

the first antenna extends in a direction substantially parallel to the first side;

the second antenna extends in a direction substantially parallel to the second side;

the first antenna is arranged substantially close to the first side; and the first antenna and the second antenna are located internally within the wireless handheld or portable device.

2. The wireless handheld or portable device according to claim 1, wherein the second antenna is arranged substantially close to the second side.

3. The wireless handheld or portable device according to claim 2, wherein the second antenna is arranged substantially close to a corner of the rectangular area.

4. The wireless handheld or portable device according to claim 1, wherein the first antenna is arranged substantially close to a corner of the rectangular area.

5. The wireless handheld or portable device according to claim 1, wherein the first antenna is an antenna selected from the group comprising: a monopole antenna, an inverted-F antenna, a patch antenna, and a planar inverted-F antenna.

6. The wireless handheld or portable device according to claim 5, wherein the second antenna is an antenna selected from the group comprising: a monopole antenna, an inverted-F antenna, a patch antenna, and a planar inverted-F antenna.

7. The wireless handheld or portable device according to claim 1, wherein the at least one frequency band used for wireless connectivity services corresponds to at least one wireless connectivity service selected from the group comprising: Bluetooth™, IEEE802.11a, IEEE802.11b, IEEE802.11g, WLAN, WiFi, UWB, ZigBee, GPS, Galileo, SDARs, XDARS, WiMAX, DAB, FM, DVB-H, and DMB.

8. A portable device comprising:

a ground plane;

a first antenna configured to transmit and receive electromagnetic waves corresponding to at least three frequency bands;

the at least three frequency bands being used for mobile communication services;

a second antenna configured to operate in at least one frequency band;

the first antenna extends in a direction substantially parallel to a first side of the portable device;

a length of a second side of the portable device is greater than a length of the first side of the portable device;

the first antenna is arranged substantially close to the first side of the portable device;

the second antenna is arranged substantially close to a first corner of the portable device;

the first corner of the portable device corresponding to a first end of the first side with an end of the second side of the portable device; and the first antenna and the second antenna are located internally within the portable device.

9. The portable device according to claim 8, wherein a portion of an orthogonal projection of the first antenna on a plane containing the ground plane does not overlap with the ground plane.

10. The portable device according to claim 8, wherein the second antenna is substantially close to the first side of the portable device and extends in a direction substantially parallel to the first side of the portable device.

11. The portable device according to claim 8, wherein the at least one frequency band is used for a mobile communication service, and said at least one frequency band being different from the at least three frequency bands.

12. The portable device according to claim 8, wherein the first antenna is an antenna selected from the group comprising: a monopole antenna, an inverted-F antenna, a patch antenna, and a planar inverted-F antenna.

13. The portable device according to claim 12, wherein the second antenna is an antenna selected from the group comprising: a monopole antenna, an inverted-F antenna, a patch antenna, and a planar inverted-F antenna.

14. A wireless handheld or portable device comprising:

a ground plane;

the ground plane is inscribed in a first rectangular area comprising a first side, a second side and a third side, a length of the second side being greater than a length of the first side and a length of the third side;

a first antenna configured to transmit and receive electromagnetic waves corresponding to at least two frequency bands;

the at least two frequency bands being used for mobile communication services;

a second antenna configured to operate in at least one frequency band;

the at least one frequency band being different from the at least two frequency bands;

the first antenna extends in a direction substantially parallel to the first side;

the first antenna is proximate to the first side;

the second antenna extends in a direction substantially parallel to the third side;

the second antenna is proximate to the third side;

the second antenna is inscribed in a second rectangular area;

a sum of a length and a width of the second rectangular area is smaller than a quarter of an operating wavelength of the second antenna;

a geometry of the first antenna being different than a geometry of the second antenna;

at least one of the first antenna and the second antenna is proximate to a corner of the first rectangular area; and the first antenna and the second antenna are located internally within the wireless handheld or portable device.

15. The wireless handheld or portable device according to claim 14, wherein the first antenna is proximate to a first corner of the first rectangular area and the second antenna is proximate to a second corner of the first rectangular area.

16. The wireless handheld or portable device according to claim 14, wherein the second antenna is contained in a plane substantially parallel to a plane containing the ground plane.

17. The wireless handheld or portable device according to claim 14, wherein the at least one frequency band is used for a wireless connectivity service selected from the group comprising: Bluetooth™, IEEE802.11a, IEEE802.11b, IEEE802.11g, WLAN, WiFi, UWB, ZigBee, GPS, Galileo, SDARs, XDARS, WiMAX, DAB, FM, DVB-H, and DMB.

18. The wireless handheld or portable device according to claim 14, wherein the first antenna is an antenna selected from the group comprising: a monopole antenna, an inverted-F antenna, a patch antenna, and a planar inverted-F antenna.

19. The wireless handheld or portable device according to claim 18, wherein the second antenna is an antenna selected from the group comprising: a monopole antenna, an inverted-F antenna, a patch antenna, and a planar inverted-F antenna.

20. The wireless handheld or portable device according to claim 14, wherein the second antenna is fitted over a curved surface.

* * * * *